US012262793B2

(12) United States Patent
Zwick et al.

(10) Patent No.: US 12,262,793 B2
(45) **Date of Patent: *Apr. 1, 2025**

(54) SHOES FOR BALL SPORTS

(71) Applicant: adidas AG, Herzogenaurach (DE)

(72) Inventors: Constantin Zwick, Herzogenaurach (DE); Robert Frank Kirk, Herzogenaurach (DE); Christian DiBenedetto, Portland, OR (US); Eva Andrea Dorschky, Buckenhof (DE); Bjoern Michael Eskofier, Erlangen (DE); Dominik Schuldhaus, Erlangen (DE); Peter Georg Laitenberger, Cambridge (GB); Iain James Sabberton, Cambridge (GB)

(73) Assignee: adidas AG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/409,938

(22) Filed: Jan. 11, 2024

(65) Prior Publication Data

US 2024/0260705 A1 Aug. 8, 2024

Related U.S. Application Data

(63) Continuation of application No. 18/071,412, filed on Nov. 29, 2022, now Pat. No. 11,903,448, which is a (Continued)

(51) Int. Cl.
*A43B 3/24* (2006.01)
*A43B 1/00* (2006.01)

(Continued)

(52) U.S. Cl.
CPC ..... *A43B 3/242* (2013.01); *A43B 1/0054* (2013.01); *A43B 3/26* (2013.01); *A43B 3/34* (2022.01);

(Continued)

(58) Field of Classification Search
CPC ..... A43B 3/242; A43B 1/0054; A43B 3/0005; A43B 1/00; A43B 3/26; A43B 5/02;

(Continued)

(56) References Cited

U.S. PATENT DOCUMENTS 4,924,605 A 5/1990 Spademan
5,230,249 A 7/1993 Sasaki et al.

(Continued)

FOREIGN PATENT DOCUMENTS

CN 101479572 A 7/2009
CN 101642292 A 2/2010

(Continued)

OTHER PUBLICATIONS

U.S. Appl. No. 14/694,379, Non-Final Office Action, Aug. 4, 2016, 7 pages.

(Continued)

*Primary Examiner* — Marie D Bays
(74) *Attorney, Agent, or Firm* — Kilpatrick Townsend & Stockton LLP

(57) ABSTRACT

Described are shoes for ball sports including an upper having an outer surface. An actuator is configured to change at least one surface property of a portion of the outer surface of the upper, and a sensor is configured to be sensitive to movements of the shoe. A processing unit is connected to the actuator and the sensor and configured to process sensor data retrieved from the sensor and to cause the actuator to change the at least one surface property of the portion of the outer surface of the upper if a predetermined event is detected in the sensor data.

20 Claims, 14 Drawing Sheets

Related U.S. Application Data continuation of application No. 17/094,097, filed on Nov. 10, 2020, now Pat. No. 11,540,589, which is a continuation of application No. 16/018,732, filed on Jun. 26, 2018, now Pat. No. 10,863,790, which is a continuation of application No. 15/449,385, filed on Mar. 3, 2017, now Pat. No. 10,039,339, which is a continuation of application No. 14/694,379, filed on Apr. 23, 2015, now Pat. No. 9,609,904.

(51) Int. Cl.

| | |
|---|---|
| ***A43B 3/26*** | (2006.01) |
| ***A43B 3/34*** | (2022.01) |
| ***A43B 3/38*** | (2022.01) |
| ***A43B 3/44*** | (2022.01) |
| ***A43B 5/02*** | (2006.01) |
| ***A43B 23/02*** | (2006.01) |

(52) U.S. Cl.

CPC ..... *A43B 3/38* (2022.01); *A43B 3/44* (2022.01); *A43B 5/02* (2013.01); *A43B 5/025* (2013.01); *A43B 23/021* (2013.01); *A43B 23/0215* (2013.01); *A43B 23/029* (2013.01)

(58) Field of Classification Search

CPC ... A43B 7/14; A43B 23/0205; A43B 23/0235; A43B 23/0265

USPC ..... 36/84, 88, 93, 97, 100, 133, 45

See application file for complete search history.

(56) References Cited

U.S. PATENT DOCUMENTS

| | | | | |
|---|---|---|---|---|
| 5,791,068 | A | 8/1998 | Bernier et al. | |
| 5,813,148 | A | 9/1998 | Guerra | |
| 5,839,210 | A | 11/1998 | Bernier et al. | |
| 6,882,086 | B2 | 4/2005 | Kornbluh et al. | |
| 7,219,449 | B1 | 5/2007 | Hoffberg | |
| 7,310,895 | B2 | 12/2007 | Whittlesey et al. | |
| 8,046,937 | B2 | 11/2011 | Beers et al. | |
| 8,141,277 | B2 | 3/2012 | Robinson et al. | |
| 8,525,386 | B2 | 9/2013 | Pas et al. | |
| 8,749,115 | B2 | 6/2014 | Pas et al. | |
| 8,935,860 | B2 | 1/2015 | Torres | |
| 9,380,834 | B2 | 7/2016 | Rushbrook et al. | |
| 9,609,904 | B2 | 4/2017 | Zwick et al. | |
| 10,039,339 | B2 | 8/2018 | Zwick et al. | |
| 10,863,790 | B2 | 12/2020 | Zwick et al. | |
| 11,903,448 | B2 * | 2/2024 | Zwick ..... | A43B 3/26 |
| 2002/0130673 | A1 | 9/2002 | Pelrine et al. | |
| 2002/0175594 | A1 | 11/2002 | Kornbluh et al. | |
| 2003/0188457 | A1 | 10/2003 | Kinan | |
| 2004/0045192 | A1 | 3/2004 | Lin | |
| 2004/0255490 | A1 | 12/2004 | Wan et al. | |
| 2005/0188566 | A1 | 9/2005 | Whittlesey et al. | |
| 2006/0218821 | A1 | 10/2006 | Hatzilias | |
| 2010/0154255 | A1 | 6/2010 | Robinson et al. | |
| 2011/0131838 | A1 | 6/2011 | Pas et al. | |
| 2011/0155307 | A1 | 6/2011 | Pelrine et al. | |
| 2011/0308113 | A1 | 12/2011 | Hartford et al. | |
| 2013/0074374 | A1 | 3/2013 | Droege et al. | |
| 2013/0104429 | A1 | 5/2013 | Torres | |
| 2013/0324887 | A1 | 12/2013 | Pas et al. | |
| 2014/0173936 | A1 | 6/2014 | Hartford et al. | |
| 2015/0059214 | A1 | 3/2015 | Donovan et al. | |
| 2015/0296922 | A1 | 10/2015 | Rushbrook et al. | |
| 2016/0345669 | A1 | 12/2016 | Orand et al. | |
| 2016/0346583 | A1 | 12/2016 | Schneider et al. | |
| 2017/0265560 | A1 | 9/2017 | Beers et al. | |
| 2017/0273599 | A1 | 9/2017 | Reese et al. | |
| 2018/0008005 | A1 | 1/2018 | Compton et al. | |

FOREIGN PATENT DOCUMENTS

| | | | |
|---|---|---|---|
| JP | 10229902 | A | 9/1998 |
| JP | 2002238611 | A | 8/2002 |
| JP | 4554870 | B2 | 9/2010 |
| JP | 2011507644 | A | 3/2011 |
| WO | 2015042216 | A1 | 3/2015 |
| WO | 2015163982 | A1 | 10/2015 |

OTHER PUBLICATIONS

U.S. Appl. No. 14/694,379, Notice of Allowance, Nov. 23, 2016, 5 pages.

U.S. Appl. No. 15/449,385, Final Office Action, Jan. 18, 2018, 6 pages.

U.S. Appl. No. 15/449,385, Non-Final Office Action, Sep. 22, 2017, 6 pages.

U.S. Appl. No. 15/449,385, Notice of Allowance, Mar. 27, 2018, 5 pages.

U.S. Appl. No. 16/018,732, Final Office Action, Mar. 19, 2020, 5 pages.

U.S. Appl. No. 16/018,732, Non-Final Office Action, Nov. 25, 2019, 8 pages.

U.S. Appl. No. 16/018,732, Notice of Allowance, Jul. 1, 2020, 5 pages.

U.S. Appl. No. 16/018,732, Notice of Allowance, Nov. 3, 2020, 7 pages.

U.S. Appl. No. 17/094,097, Non-Final Office Action, May 20, 2022, 5 pages.

U.S. Appl. No. 17/094,097, Notice of Allowance, Sep. 2, 2022, 5 pages.

U.S. Appl. No. 17/094,097, Supplemental Notice of Allowability, Oct. 5, 2022, 3 pages.

Baker et al., "The Berkeley FrameNet Project", Proceedings of the 36th Annual Meeting of the Association Form Computational Linguistics and 17th International Conference on Computational Linguistics, vol. 1, 1998, pp. 86-90.

Breiman, "Random Forests", Machine Learning, vol. 45, No. 1, Jan. 2001, pp. 5-32.

Chinese Patent Application 201610258510.8 , Office Action, May 28, 2018, 12 pages.

Chinese Patent Application No. 201610258510.8 , Office Action, Sep. 5, 2017, 14 pages.

Duda et al., "Pattern Classification", John Wiley & Sons, 2nd Edition, 2000, 28 pages.

European Patent Application No. 16166347.1, Extended European Search Report, Oct. 13, 2016, 8 pages.

European Patent Application No. 16166347.1 , Office Action, Nov. 23, 2017, 5 pages.

European Patent Application No. 20150548.4 , European Extended Search Report, Aug. 19, 2022, 6 pages.

European Patent Application No. 20150548.4, European Search Report, Jun. 22, 2020, 8 pages.

Hastie et al., "The Elements of Statistical Learning", vol. 2, 2009, pp. 1-764.

Japanese Patent Application No. 2016-077842 , Office Action, Dec. 5, 2017, 7 pages.

Theodoridis et al., "Pattern Recognition", Elsevier, 4th edition, 2008, 3 pages.

Vetterli et al., "Wavelets and filter banks: Theory and design", IEEE Transactions on Signal Processing, vol. 40, No. 9, 1992, pp. 2207-2232.

U.S. Appl. No. 18/071,412, Non-Final Office Action, Jun. 28, 2023, 6 pages.

U.S. Appl. No. 18/071,412, Notice of Allowance, Oct. 12, 2023, 6 pages.

* cited by examiner

HMM of the event to be determined with the states $z_K \in \{1, ..., \nu\}$ and outputs $\gamma$.

HMM of the NULL class with the states $z_N \in \{1, 2\}$ and outputs $\gamma$.

HMM of the event to be determined with the states $z_K \in \{1, ..., \nu\}$, outputs $\gamma$ and parameters $\Theta_K = \{A_K, B_K, \pi_K\}$ HMM of the NULL class with the states $z_N \in \{1, 2\}$, outputs $\gamma$ and parameters $\Theta_N = \{A_N, B_N, \pi_N\}$

SHOES FOR BALL SPORTS

CROSS REFERENCE TO RELATED APPLICATIONS

This is a continuation of U.S. patent application Ser. No. 18/071,412 entitled "Shoes for Ball Sports" filed Nov. 29, 2022, which is a continuation of U.S. patent application Ser. No. 17/094,097 entitled "Shoes for Ball Sports" filed Nov. 10, 2020, which is a continuation of U.S. patent application Ser. No. 16/018,732 entitled "Shoes for Ball Sports" filed Jun. 26, 2018,which is a continuation of U.S. patent application Ser. No. 15/449,385 entitled "Shoes for Ball Sports" filed Mar. 3, 2017, now U.S. Pat. No. 10,039,339, which is a continuation of U.S. patent application Ser. No. 14/694,379 entitled "Shoes for Ball Sports" filed Apr. 23, 2015, now U.S. Pat. No. 9,609,904, the contents of which are incorporated herein by reference.

FIELD OF THE INVENTION

The present invention relates to a shoe for ball sports.

BACKGROUND

In ball sports such as soccer, football, American football, rugby and the like, a player's foot usually has contact with the ball in very different situations of e.g. a match. For example, a ball may be kicked with the intention to take a shot at the goal (e.g. by a striker or during a penalty), be passed to another player, be kept under control during dribbling, be received after a teammate's pass, etc.

In all those situations, a player makes different demands on his/her shoe. For example, when the player kicks the ball, he/she wants high friction and maximum energy transfer. However, when the player controls the ball, he/she wants a smooth surface and direct touch to the ball.

Known shoes for ball sports are often a compromise between those different demands. Thus, there are usually match situations, in which the shoe does not perform optimally. Other shoes are specifically tailored for certain match situations. For example, soccer shoes are known, which have a structured surface on the upper with fin-like projections which aim to increase the friction with the ball, e.g. to make the ball spin during flight. However, those shoes are not optimal, when it comes to controlling the ball due to the structured surface.

It is therefore an object of the present invention to provide a shoe for ball sports with optimal surface properties in a variety of match situations.

This and other objects which become apparent when reading the following description are solved by the shoe in accordance with claim 1.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a shoe for ball sports comprises an upper having an outer surface, an actuator configured to change at least one surface property of a portion of the outer surface of the upper, and a sensor configured to be sensitive to movements of the shoe. A processing unit is connected to the actuator and the sensor and configured to process sensor data retrieved from the sensor and to cause the actuator to change the at least one surface property of the portion of the outer surface of the upper if a predetermined event is detected in the sensor data.

In some embodiments, at least one surface property is the surface structure of the portion of the outer surface. The at least one surface property may be the friction of the portion of the outer surface or the surface area of the portion of the outer surface.

In certain embodiments, at least the portion of the outer surface of the upper may be elastic and the shoe may further comprise a plurality of fins arranged below the portion of the outer surface of the upper and connected to the actuator, such that the fins can be lowered or raised by means of the actuator to change the at least one surface property of the elastic portion of the outer surface.

In further embodiments, at least the portion of the outer surface of the upper may be elastic and the actuator may be a pneumatic valve, and the shoe may further comprise an air pump configured to provide pressurized air to the pneumatic valve, and at least one inflatable element arranged under the elastic portion of the outer surface of the upper, wherein the pneumatic valve is configured to provide pressurized air to the inflatable element to inflate the inflatable element and to change the at least one surface property of the portion of the outer surface. The pressurized air may be generated through actions of a player wearing the shoe.

In additional embodiments, at least the portion of the outer surface of the upper may be elastic and the shoe may further comprise a plurality of pins arranged below the elastic portion of the outer surface of the upper, and an undulating structure arranged below the plurality of pins and connected to the actuator, such that the undulating structure can be moved relative to the pins to lower or raise the pins with respect to the outer surface to change the at least one surface property of the portion of the outer surface.

In certain embodiments, the portion of the outer surface comprises a plurality of flaps, which are configured to be lowered or raised by means of the actuator. The actuator may be based on a shape memory alloy or an electrical motor.

The sensor may be an accelerometer, a gyroscope, or a magnetic field sensor.

The outer surface may be skin-like.

According to certain embodiments, the shoe further comprises a sole, wherein the sensor, actuator, and processing unit are integrated in the sole.

In some embodiments, the predetermined event is a kick. The predetermined event may also be a short pass, long pass, shot, or control of a ball.

In certain embodiments, the processing unit is adapted to detect the predetermined event by retrieving a time-series of sensor data from the sensor, preprocessing the time-series, segmenting the time-series in a plurality of windows, extracting a plurality of features from the sensor data in each of the plurality of windows, and estimating an event class associated with the plurality of windows based on the plurality of features extracted from the sensor data in the plurality of windows.

The time-series may be preprocessed by digital filtering using for example a non-recursive moving average filter, a Cascade Integrator Comb filter or a filter bank.

The event class may comprise at least the event to be detected and a NULL class associated with the sensor data that does not belong to a specific event.

In certain embodiments, the features are based at least on one of temporal, spatio-temporal, spectral, or ensemble statistics by applying, for example, wavelet analysis, principal component analysis, or Fast Fourier Transform.

In further embodiments, the features are based on one of simple mean, normalized signal energy, movement intensity, signal magnitude area, correlation between axes, maximum value in a window, minimum value in a window, maximum detail coefficient of a wavelet transform, correlation with a template, projection onto a principal component of a template, distance to an eigenspace of a template, spectral centroid, bandwidth, or dominant frequency.

The time-series may be segmented in the plurality of windows based on a sliding window. The time-series may also be segmented in the plurality of windows based on at least one condition present in the time-series. In some embodiments, the at least one condition is the crossing of the sensor data of a defined threshold or the matching of a template using correlation, Matched Filtering, Dynamic Time Warping, or Longest Common Subsequence and its sliding window variant, warping Longest Common Subsequence.

In some embodiments, the event class is estimated based on a Bayesian classifier such as Naïve Bayes classifier, a maximum margin classifier such as Support Vector Machine, an ensemble learning algorithm such as AdaBoost classifier and Random Forest classifier, a Nearest Neighbor classifier, a Neural Network classifier, a Rule based classifier, or a Tree based classifier. In further embodiments, the event class is estimated based on probabilistic modeling the sequential behavior of the events and a NULL class by Conditional Random Fields or dynamic Bayesian networks. In additional embodiments, the event class is estimated based on a hybrid classifier, comprising the steps of: discriminating between different phases of the event to be detected and a NULL class, wherein the NULL class is associated with the sensor data that does not belong to a specific event, and modeling the sequential behavior of the event and the NULL class by dynamic Bayesian networks.

In some embodiments, the step of estimating is based on a classifier that has been trained based on supervised learning. In further embodiments, the step of estimating is based on a classifier that has been trained based on online learning. In additional embodiments, the step of estimating is based on dynamic Bayesian networks that have been trained based on unsupervised learning.

The predetermined event may be detected in real-time.

BRIEF DESCRIPTION OF THE DRAWINGS

In the following detailed description, embodiments of the invention are described referring to the following figures.

BRIEF DESCRIPTION

Figure 1A:
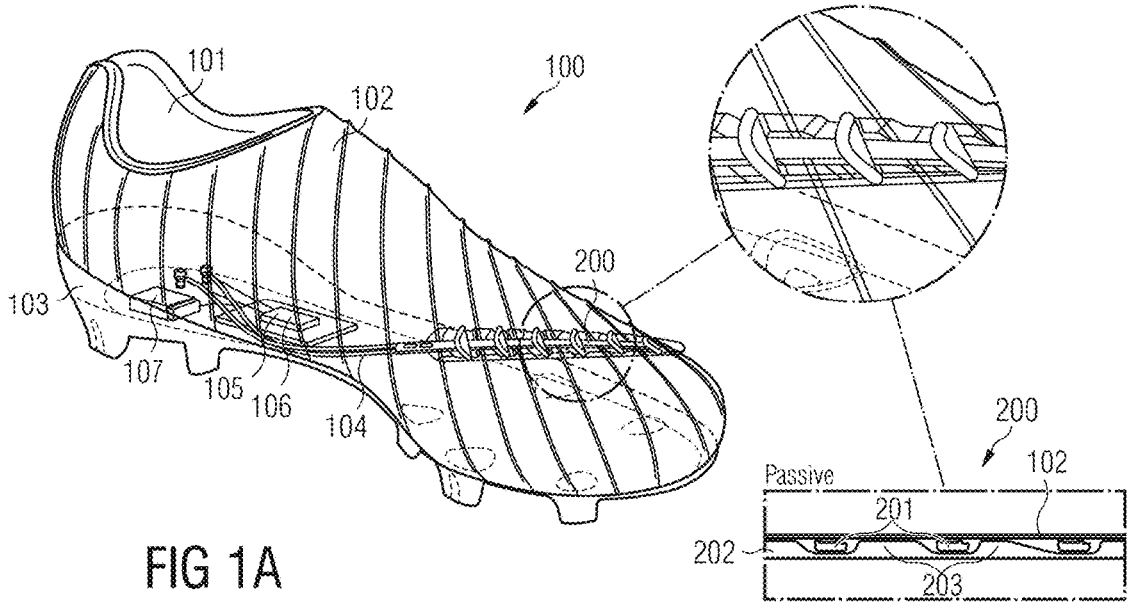
FIG. 1A is a perspective view and certain partially expanded views of a shoe in passive state, according to certain embodiments of the present invention.

According to the present invention, a shoe for ball sports, comprises: (a.) an upper having an outer surface; (b.) an actuator being configured to change at least one surface property of a portion of the outer surface of the upper; (c.) a sensor being sensitive to movements of the shoe; and (d.) a processing unit connected to the actuator and the sensor and being configured to process sensor data retrieved from the sensor and to cause the actuator to change at least one surface property of the portion of the outer surface of the upper if a predetermined event is detected in the sensor data.

A movement in the context of the present description is understood as a translational movement, a rotational movement (a rotation) or a combination of both. In general, a movement is understood as a change of the kinematical state, i.e. acceleration, deceleration, rotation, etc. The kinematical state can be described by position, velocity and orientation. Hence, a movement as understood in the present context changes at least one of position, velocity, acceleration and orientation.

The particular combination of features according to the invention allows the shoe to adapt to the particular match situation. For example, the processing unit may detect that the player wearing the shoe is just about performing a hard long distance shot. In this situation, the processing unit may instruct the actuator to change at least one surface property, e.g. the friction, of the portion of the outer surface of the upper such that the friction with the ball is increased. For example, the surface structure may be changed from a smooth surface to a ripped, corrugated or fin-like structure. Conversely, if the processing unit detects that the player is performing a dribbling, it may instruct the actuator to change the surface structure of the upper to a smooth surface configuration with direct touch to the ball.

In this way, the shoe according to the invention is in an optimal surface configuration in each situation of a match. Other than prior art shoes, the inventive shoe is not a compromise.

It should be noted that the shoe according to the invention comprises at least one actuator, i.e. at least one actuator and at least one sensor, i.e. at least one sensor.

The at least one surface property may be the surface structure of the portion of the outer surface of the upper. Thus, if the processing unit detects for example that the player controls the ball, it may cause the actuator to change the surface structure of the portion of the outer surface of the upper to allow for optimal control of the ball, e.g. by providing it with an undulating structure.

The at least one surface property may be the friction of the portion of the outer surface of the upper. Thus, if the processing unit detects for example that the player makes a hard shot, it may cause the actuator to increase the surface friction of the portion of the outer surface of the upper so that the player may shoot the ball with a lot of spin.

It should be noted that multiple surface properties may be changed at once. Thus the structure may be change simultaneously with the friction. Friction may be changed simultaneously with surface area. Surface area may be change simultaneously with surface structure. All three of the mentioned properties may be changed simultaneously. Also, this list of properties is not limiting and other properties may be changed as well within the context of the present invention.

The actuator may change at least one surface property of the portion of the outer surface of the upper either directly or indirectly. The actuator may change the surface property directly if no further mechanism is involved to change the surface property. For example an actuator which changes its state, such as volume, size, shape, length, etc. under certain conditions (such as an electroactive polymer, a shape memory alloy, a piezo crystal, etc.) may be arranged under the outer surface of the upper and may change the surface property (such as surface structure, friction, surface area, etc.) directly when changing its state.

The actuator may change the surface property indirectly if the actuator changes its state, such as volume, size, shape, length, etc. and thereby drives a mechanism which in turn causes the change of the surface property (such as surface structure, friction, surface area, etc.).

In the following, examples and embodiments are described for both alternatives, i.e. actuators changing at least one surface property directly and indirectly.

At least a portion of the outer surface of the upper may be elastic and the shoe may further comprise a plurality of fins arranged below the portion of the outer surface of the upper connected to the actuator, such that the fins can be lowered or raised by means of the actuator to change the at least one surface property of the elastic outer surface.

"Elastic" in the context of the present invention is understood in that the outer surface of the upper deforms under force and/or pressure, but restores its shape almost entirely (up to small tolerances) to the initial state.

This kind of mechanism allows for large lifts of the fins, i.e. there is a big difference between a smooth configuration of the surface in which the fins are lowered and a high friction configuration in which the fins are raised.

At least a portion of the outer surface of the upper may be elastic and the actuator may be a pneumatic valve and the shoe may further comprise an air pump configured to provide pressurized air to the pneumatic valve and may comprise at least one inflatable element arranged under the elastic outer surface of the upper, wherein the pneumatic valve is configured to provide pressurized air to the inflatable element to inflate the inflatable element and to change the at least one surface property of the portion of the outer surface of the upper.

Thus, the inflatable element being arranged under the elastic surface directly influences the at least one surface property and, therefore, for example the friction of the surface. This construction has the advantage of having only a few movable parts, i.e. the pneumatic valve and the inflatable elements. Therefore, it is a very robust construction.

It is to be noted that the actuator may comprise more than one pneumatic valve and that the shoe may comprise two or more air pumps.

The pressurized air may be generated through actions of a player wearing the shoe. For example, a bladder may be connected to an air reservoir via a valve which allows a flow of air in only one direction. When the player walks, runs or jumps, the bladder is compressed and air is forced through the valve into the air reservoir. In this way, the pressure of the air in the air reservoir is increased. Thus, the energy needed to change the at least one surface property of the upper is provided by the movements of the player wearing the shoe and no further energy source, such as a battery (besides the battery for the processing unit, the valve and the sensor), is needed.

At least the portion of the outer surface of the upper may be elastic and the shoe may further comprise a plurality of pins arranged below the elastic outer surface of the upper; and an undulating structure arranged below the plurality of pins and connected to the actuator, such that the undulating structure can be moved relative to the pins to lower or raise the pins with respect to the outer surface to change the at least one surface property of the portion of the outer surface.

Pins allow to generate very fine-grained structures on the surface of the upper. Thus, the friction achievable with this construction is high, while the control of the ball, i.e. the "touch" can be maintained.

A "pin" in the context of the present invention is understood as any structure that is able to change the surface properties by moving against the elastic outer surface. Thus, a pin may have the shape of a nib, a ball, a pyramid, a cube, etc.

The portion of the outer surface may comprise a plurality of flaps which are configured to be lowered or raised by means of the actuator. This construction can mimic the appearance and behavior of known shoes with structured surfaces (e.g. with ribbed configuration or fin-like projections), while at the same time the flaps may be lowered in situations where control of the ball is needed, e.g. during a dribbling.

The actuator may be based on a shape memory alloy (for example wires) or an electrical motor. Shape memory alloys and electrical motors allow the actuator to exert rather large forces in order to adjust the at least one surface property of the upper, while at the same time they show only a moderate need of electrical energy. Shape memory alloy is an alloy that returns to its original shape when deformed and heated. For example, a shape memory alloy wire may be heated e.g. via a current flowing through the wire. When a certain temperature threshold is reached, the wire contracts. After cooling down below the temperature threshold, the wire relaxes and returns to its original state, i.e. length and/or shape. The material is especially lightweight and allows for a very small actuator.

The actuator may be based on a solenoid. A solenoid generates a magnetic field if powered by a current source. The magnetic field may exert a force on ferromagnetic material. Thus, the solenoid may drive a mechanism which changes the surface properties of the portion of the outer surface of the upper.

The actuator may be a thermal actuator. A thermal actuator changes the temperature of a material with a preferably large coefficient of thermal expansion. Thus, as the temperature changes, so does the length of the material which may be used to drive a mechanism which changes the surface properties of the portion of the outer surface of the upper.

The actuator may be a pneumatic actuator. For example a small piston could be driven by pressurized air to drive in turn a mechanism which changes the surface properties of the portion of the outer surface of the upper.

The actuator may be an electroactive polymer. Such polymers exhibit a shape change in response to electrical stimulation. For example, if a voltage is applied to such a polymer, the polymer may contract in the direction of the field lines and expand perpendicular to them. An electroactive polymer may be created by laminating thin films of dielectric elastomers on the front and back with carbon containing soft polymer films. The main types of electroactive polymers which may be used in the context of the present invention include electronic electroactive polymers which are drive by an electric field, ionic electroactive polymers which involve mobility of ions, and nanotubes.

At least the portion of the outer surface of the upper may be elastic and the electroactive polymer may be arranged below the elastic portion, such that a change of the shape of the electroactive polymer causes a change of the surface property of the elastic portion of the outer surface of the upper. In this way, the surface property may be directly changed by the actuator without a further mechanism. The change in shape of the electroactive polymer may include a change in length, volume, thickness, width, surface area, modulus of elasticity and/or modulus of rigidity.

The actuator may be an electroactive polymer and may be coupled to a mechanism, such that the electroactive polymer may change a surface property of a portion of the outer surface of the upper via the mechanism. The mechanism may be a mechanism as described above, i.e. pins, flaps and/or fins.

The actuator may drive a latched mechanism. In a latched mechanism, the force to drive the mechanism which changes the surface properties of the portion of the outer surface of the upper is provided by a pre-stressed element, such as a spring, elastic strap, compressed bladder, etc. The actuator is used to release the pre-stressed element from the pre-stressed state into an unstressed state. A mechanism which changes the surface properties of the portion of the outer surface of the upper is driven by this transition.

The actuator may be supported by a pre-stressed element. For example, the force from a pre-stressed spring, elastic strap, or compressed bladder may add to the force of the actuator to support the actuator.

The sensor may be an accelerometer, a gyroscope or a magnetic field sensor. Such kinds of sensors are suitable to reliably detect changes of the kinematical state (i.e. motion, rotation, and orientation) of the shoe. The kinematical state of the shoe is directly related to the motion (e.g. kick, shot, pass, control, etc.) the player is performing.

The outer surface may be skin-like. A skin-like outer surface provides a direct control and touch to the ball in situations in which the processing unit has instructed the actuator to cause a smooth surface of the upper.

The shoe may further comprise a sole, wherein the sensor, actuator and processing unit are integrated in the sole. This arrangement is space-saving and achieves maximum protection of the sensor, actuator and processing unit. Alternatively, at least a portion of the actuator may extend into the upper, especially, if shape memory alloy ("SMA") wires are used. For example a SMA wire could be anchored to a sole plate and extend into the upper.

The predetermined event detected by the processing unit may be a kick. Kicks are regularly performed in sports such as soccer, football, American football and rugby. Therefore, adapting the shoe for a kick is of high value for the player.

The predetermined event may be a short pass, long pass, shot, or control of a ball. Also these events are regularly performed in sports such as soccer, football, American football and rugby. Therefore, adapting the shoe for one of those events is of high value for the player.

The processing unit may be adapted to detect the predetermined event by performing the following steps: (a.) retrieving a time-series of sensor data from the sensor; (b.) preprocessing the time-series applying filters and appropriate signal processing methods (c.) segmenting the time-series in a plurality of windows; (d.) extracting a plurality of features from the sensor data in each of the plurality of windows; and (e.) estimating an event class associated with the plurality of windows based on the plurality of features extracted from the sensor data in the plurality of windows.

This sequence of steps allows for a reliable detection of events, is computationally inexpensive, capable for real-time processing and can be applied to a vast spectrum of different events during a match. In particular, events can be detected before they are actually completed. For example, a shot can be identified in an early phase. These advantages are achieved by the particular combination of steps. Thus, by segmenting the time-series retrieved by the sensor in a plurality of windows, the processing of the data can be focused to a limited amount of data given by the window size. By extracting a plurality of features from the sensor data in each of the windows, the dimension of the problem can be reduced. For example, if each window comprises a few hundred data points, extracting about a dozen of relevant features results in a significant reduction of computational costs. Furthermore, the subsequent step of estimating an event class associated with the plurality of windows needs to operate on the extracted features only, but not on the full set of data points in each window.

The event class may comprise at least the predetermined event to be detected. A NULL class is associated with sensor data that does not belong to any of the specified events. In this way, a discrimination can be made between those events which are of interest for the particular activity and all other events.

The time-series may be segmented in a plurality of windows based on a sliding window. Sliding windows may be easily implemented and are computationally inexpensive.

The time-series may be segmented in a plurality of windows based on at least one condition present in the time-series. In this way, it may be guaranteed that each of the windows is in a fixed temporal relationship with the predetermined event to be detected. For example, the temporal location of the first window of the plurality of windows may coincide with the beginning of the predetermined event.

The condition may be the crossing of the sensor data of a defined threshold. Crossing of sensor data can easily be detected, is computationally inexpensive and shows good correlation with the temporal location of events to be detected.

The time-series may be segmented in a plurality of windows based using matching with a template of an event that is defined using known signals of pre-recorded events. The matching may be based on correlation, Matched Filtering, Dynamic Time Warping, or Longest Common Subsequence ("LCSS") and its sliding window variant, warping LCSS.

The features may be based at least on one of temporal, spatio-temporal, spectral, or ensemble statistics by applying, for example, wavelet analysis, principal component analysis ("PCA") or Fast Fourier Transform ("FFT"). The mentioned statistics and transforms are suitable to derive features from the time-series in each of the windows which are as non-redundant as possible and allow for a reliable detection of events.

The features may be based on one of simple mean, normalized signal energy, movement intensity, signal magnitude area, correlation between axes, maximum value in a window, minimum value in a window, maximum detail coefficient of a wavelet transform, correlation with a template, projection onto a principal component of a template, distance to an eigenspace of a template, spectral centroid, bandwidth, or dominant frequency. These kinds of features have been found to allow for a reliable detection of events associated with human motion.

The event class may be estimated based on a Bayesian Classifier such as Naïve Bayes classifier, a maximum margin classifier such as Support Vector Machine, an ensemble learning algorithm such as AdaBoost classifier and a Random Forest classifier, a Nearest Neighbor classifier, a Neural Network classifier, a Rule based classifier, or a Tree based classifier. These methods have been found to provide for a reliable classification of events associated with human activity.

The event class may be estimated based on probabilistic modeling the sequential behavior of the events and the NULL class by Conditional Random Fields, dynamic Bayesian networks or other.

The event class may be estimated based on a hybrid classifier, comprising the steps of: (a.) discriminating between different phases of the predetermined event to be detected and a NULL class, wherein the NULL class is associated with sensor data that does not belong to a specific event; and (b.) modeling the sequential behavior of the event and the NULL class by dynamic Bayesian networks, e.g. Hidden Markov type models. Such a hybrid classification increases the response time and is, therefore, ideally suited for real-time detection of events. This is due to the fact, that a hybrid classifier may classify an event before it has actually finished.

The step of estimating may be based on a classifier which has been trained based on supervised learning. Supervised learning allows adapting the classifier to predetermined classes of events (e.g. kicks, shots, passes, etc.) and/or to predetermined types of athletes (e.g. professional, amateur, recreational), or even to a specific person.

The step of estimating may be based on dynamic Bayesian networks which have been trained based on unsupervised learning. Unsupervised learning allows modeling the NULL class which compromises unspecific events.

The step of estimating may be based on a classifier which is trained based on online learning. Online learning allows adapting the classifier to the shoe wearer without human interaction. This could be realized by a feedback loop, updating the classifier after detection of the ball contact.

The predetermined event may be detected in real-time. Real-time analysis may be used to predict certain events and to initiate an adaption of the at least one surface property of the portion of the outer surface of the upper by the actuator.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1B:
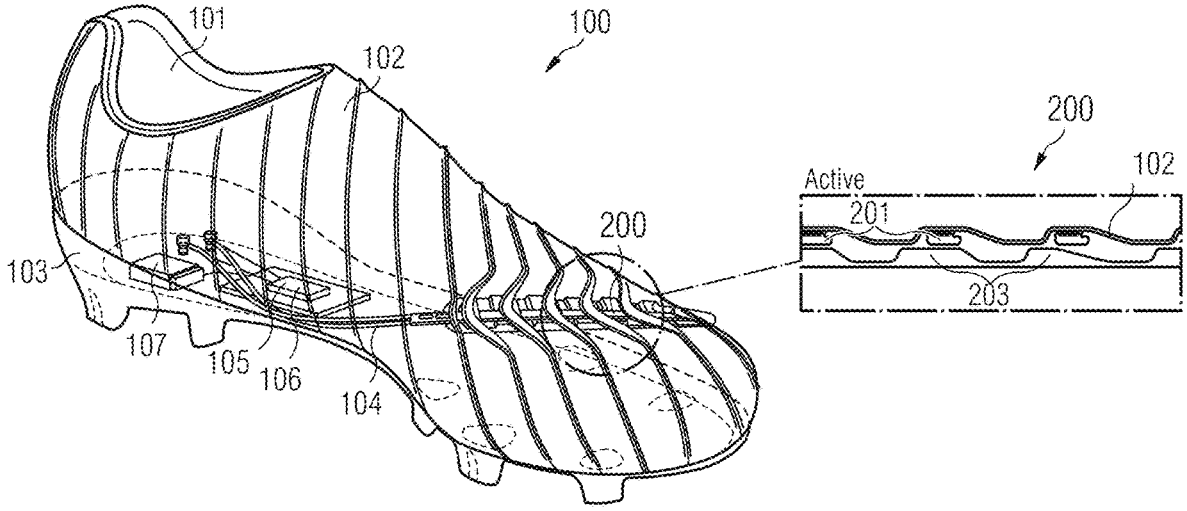
FIG. 1B is a perspective view of the shoe of FIG. 1A in an active state.

FIGS. 1*a* and 1*b* show a schematic drawing of certain embodiments of a shoe 100 for ball sports according to the present invention. Such a shoe 100 may be used for ball sports such as soccer, football, American football, rugby, and the like. As can be seen in FIGS. 1*a* and 1*b*, the shoe 100 comprises an upper 101 having an outer surface 102. The upper 101 may be made from conventional materials, such as leather, synthetic leather, plastics such as polyester, and the like. If the upper is made from yarns, it may for example be weft knitted, warp knitted, woven and the like.

As shown in FIGS. 1*a* and 1*b*, the upper 101 is connected to a sole 103. The sole 103 can be made from conventional materials such as ethylene-vinyl acetate ("EVA"), polyurethane ("PU"), thermoplastic polyurethane ("TPU") and the like. The upper 101 can be connected to the sole 103 for example via gluing, sewing, welding or other techniques.

The shoe comprises an actuator 104 being configured to change at least one surface property of a portion of the outer surface 102 of the upper 101. In the embodiments of FIGS. 1*a* and 1*b*, the actuator 104 is based on a shape memory alloy (SMA), i.e. it comprises one wire made from SMA in a V-shaped configuration. Instead of one SMA wires, multiple wires may be used and the configuration may be different, e.g. U-shaped, S-shaped, etc. Also, any material besides SMA which is able to change its shape may be used. In general, an electrical motor or a pneumatic valve could also be used as actuator 104.

The portion of the outer surface 102 of the upper 101 the property of which is changed may be arranged in the forefoot area, only on a medial side, only on the lateral side, on both sides, in the heel area, in the (medial and/or lateral) midfoot area, etc. The portion may also be arranged on any combination of the areas mentioned before. Thus, a "portion" is understood as a single area, or two or more separate and distinct areas on the surface 102 of the upper 101. In general, the portion whose property is changed may be arranged at arbitrary positions on the surface 102 of the upper 101.

With respect to all embodiments described herein, the at least one surface property may be the surface structure of the portion of the outer surface 102 of the upper 101 Thus, if the processing unit 106 detects for example that the player controls the ball, it may cause the actuator 104 to change the surface structure of the portion of the outer surface 102 of the upper 101 to allow for optimal control of the ball, e.g. by providing it with an undulating structure. Furthermore, the at least one surface property may be the friction of the portion of the outer surface of the upper. Thus, if the processing unit 106 detects for example that the player makes a shot, it may cause the actuator 104 to increase the surface friction of the portion of the outer surface 102 of the upper 101 so that the player may shoot the ball with a lot of spin. The at least one surface property may be the friction of the portion of the outer surface of the upper. Thus, if the processing unit 106 detects for example that the player makes a shot, it may cause the actuator 104 to increase the surface friction of the portion of the outer surface 102 of the upper 101 so that the player may shoot the ball with a lot of spin.

It should be noted that multiple surface properties may be changed at once. Thus the structure may be change simultaneously with the friction. Friction may be changed simultaneously with surface area. Surface area may be change simultaneously with surface structure. All three of the mentioned properties may be changed simultaneously. Also, this list of properties is not limiting and other properties may be changed as well within the context of the present invention.

The shoe 100 comprises at least one sensor 105 being sensitive to movements of the shoe 100. The sensor 105 may be any type of sensor which is capable to measure movements of the shoe 100, such as an accelerometer, a gyroscope or a magnetic field sensor. In addition, a combination of different sensors may be used, i.e. the sensor 105 may be capable of measuring a combination of acceleration, rotation and magnetic fields to improve accuracy. Multiple separate sensors may be used for this purpose as well.

As shown in FIGS. 1*a* and 1*b*, the shoe also comprises a processing unit 106 which is connected to the actuator 104 and which in these embodiments is arranged in the same housing as the sensor 105. However, the processing unit 106 could also be arranged in a separate housing. The processing unit 106 is configured to process sensor data retrieved from the sensor 105. The processing unit 106 is furthermore configured to cause the actuator 104 to change at least one surface property of a portion of the outer surface 102 of the upper 101 if a predetermined event is detected in the sensor data. Such an event may for example be a kick, a short pass, long pass, shot or control of the ball. As described in detail below, the processing unit may apply techniques to detect an event before it has actually finished. Thus, the processing unit may cause the actuator to adapt at least one surface property of the portion of the upper before the impact of a ball.

Also shown in the embodiments of FIGS. 1*a* and 1*b* is a battery 107 which provides the necessary electrical power to the processing unit 106, the sensor 105 and the actuator 104. The battery could be replaced when becoming low. Alternatively, the battery could be rechargeable and could be recharged by inductive charging or using a wire cable (e.g. a USB cable). Instead of a battery, a piezo crystal, a magnet and a coil, or any other energy harvesting technique could be used which generates the necessary power from pressure caused by movements of the wearer.

FIG. 1A shows the upper 101 with a "passive" surface structure, i.e. the processing unit 106 has not detected a predetermined event in the sensor data and has not caused the actuator 104 to change the surface properties of a portion of the outer surface 102 of the upper 101. As shown in FIG. 1A, the upper 101 comprises a smooth surface.

In contrast, FIG. 1B shows the upper 101 with an "active" surface structure, i.e. the processing unit 106 has detected a predetermined event in the sensor data and has caused the actuator 104 to change at least one surface property of a portion of the outer surface 102 of the upper 101. As shown in FIG. 1B, a portion of the outer surface 102 of the upper 101 has changed its structure from a smooth appearance to a corrugated appearance, i.e. both the friction as well as the surface area of the portion is increased due to the corrugated surface. The underlying mechanism 200 for changing the surface structure is also shown in FIGS. 1*a* and 1*b* and described in detail in the following with reference to FIGS. 2A and 2B.

An exemplary mechanism 200 to change the surface structure of the upper 101 by means of the actuator 104 is described with reference to FIGS. 2A and 2B. In these embodiments, at least a portion of the outer surface 102 of the upper 101 is elastic. "Elastic" in the context of the present invention is understood in that the outer surface of the upper deforms under force and/or pressure, but restores its shape almost entirely (up to small tolerances) to the initial state.

A plurality of fins 201 is arranged below the elastic portion of the outer surface of the upper 101. The fins 201 are arranged in a flexible hinge structure below the outer surface 102 of the upper 101. Below the fins 201 a sliding layer 202 is arranged which contains several features 203 which interact with the fins 201 as the two layers move relative to each other. Relative movement of the fins 201 and the sliding layer 202 is caused by the actuator 104 either pulling or pushing either the fins 201 or the sliding layer 202. This relative movement causes the hinge structures, i.e. the fins 201 to move in and out of a plane which is coplanar with the fins 201. As the fins 201 are arranged below the elastic outer surface 102 of the upper 101, the corrugation, appearance and properties of the outer surface 102 is changed.

Figure 2A:
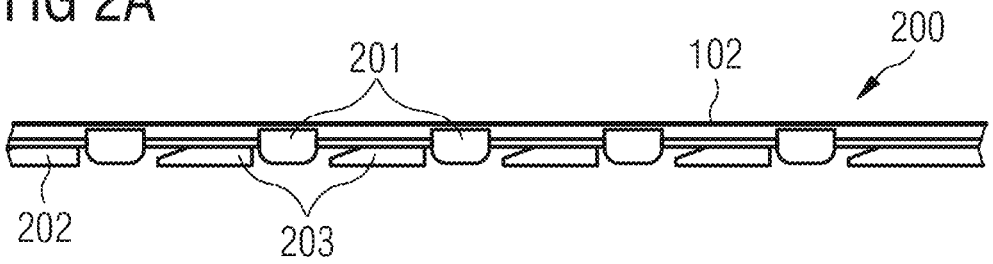
FIGS. 2A and 2B schematically depict a mechanism for changing a surface property using flaps, according to certain embodiments of the present invention.
Figure 2B:
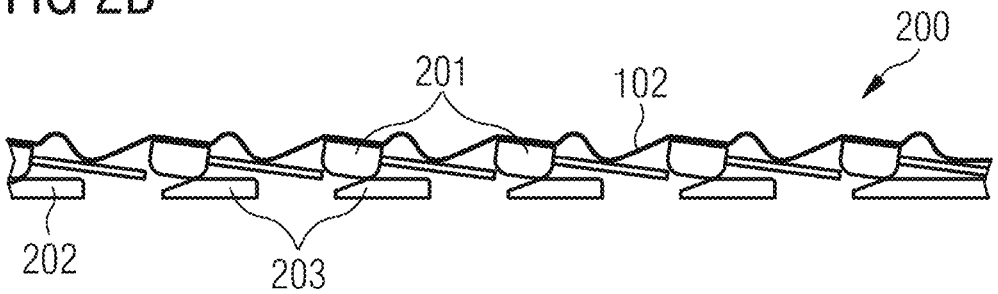

Thus, as can be seen in FIG. 2A, in a lower state of the fins 201 the features 203 of the sliding layer 202 are arranged between the ends of the fins 201. As the actuator 104 (not shown in FIGS. 2A and 2B) either pushes or pulls the fins 201 or the sliding layer 202, the angled ends of the features 203 push the ends of the fins 201 upward as can be seen in FIG. 2B.

After the transition to the active state in which at least one surface property of the portion of the outer surface 102 of the upper 101 is changed, the mechanism may transition back to the passive state again. This transition may be cause by a spring mechanism using either a spring or the elastic properties of a material (this could be a separate material or the elastic surface of the upper 101 itself). Also, multiple actuator systems may be used, where two or more actuators are triggered at different times and a first actuator pulls in the "active" direction while a second actuator pulls in the opposite, "passive" direction and restores the mechanism into its initial state.

Figure 3A:
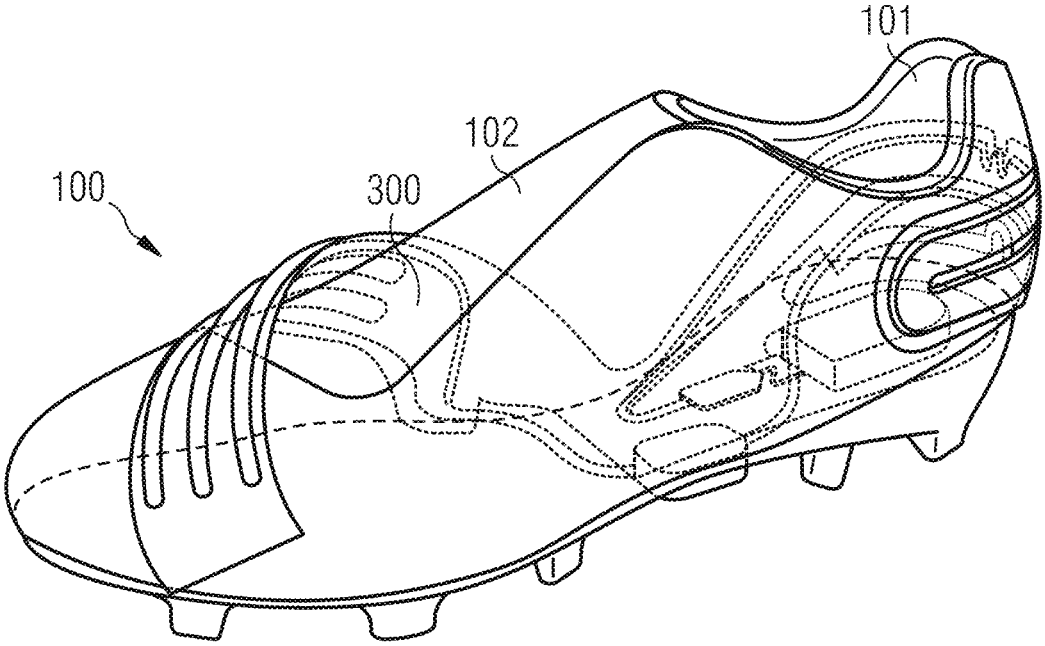
FIGS. 3A, 3B and 4 are perspective views of a pressurized air system in a shoe, according to certain embodiments of the present invention.
Figure 3B:
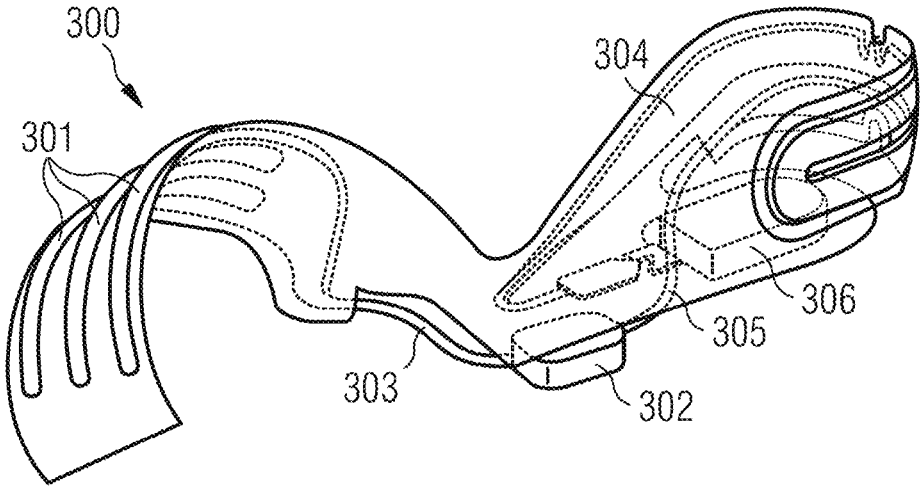
Figure 4:
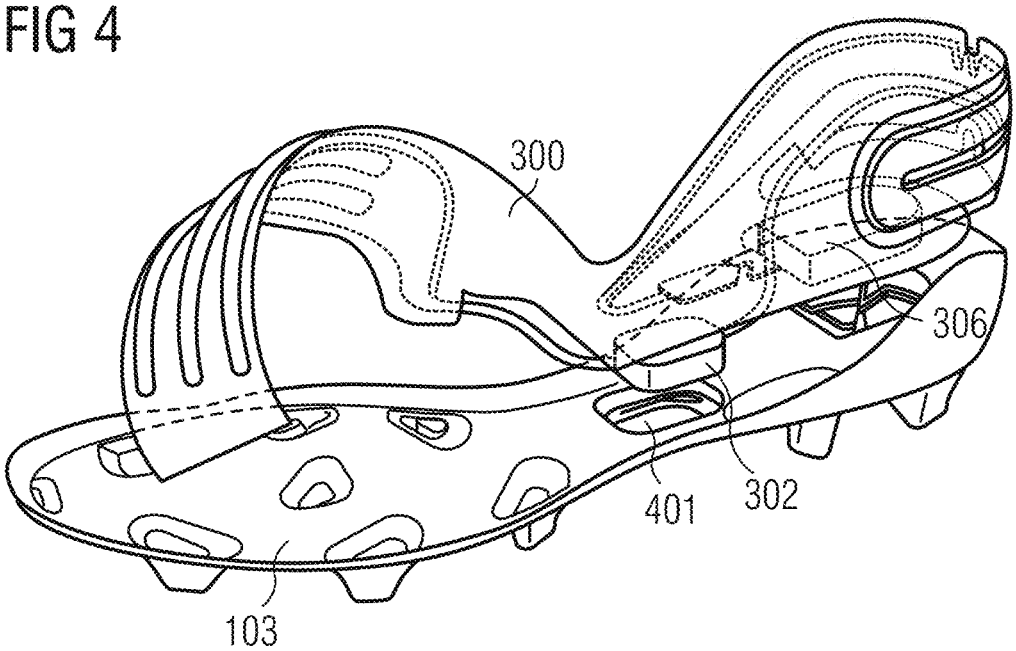

A further exemplary mechanism 300 to change the surface structure of the upper 101 by means of the actuator 104 is described with reference to FIGS. 3A, 3B and 4, wherein FIG. 3A shows the entire shoe 100 and FIGS. 3B and 4 show details of the mechanism 300. Also in these embodiments, at least a portion of the outer surface 102 of the upper 101 is elastic. A plurality of inflatable elements 301 in the form of stripes are arranged below the elastic portion of the outer surface 102 of the upper 101. Of course, the number of inflatable elements 301 may vary, as well as does the shape of the inflatable elements. For example, the number of inflatable elements may range between 1 and 10, but more inflatable elements could be used. Furthermore, instead of stripes, dot-shaped or undulating inflatable elements may be used.

The portion of the outer surface 102 of the upper 101 the property of which is changed may be arranged in the forefoot area, only on a medial side, only on the lateral side, on both sides, in the heel area, in the (medial and/or lateral) midfoot area, etc. The portion may also be arranged on any combination of the areas mentioned before. Thus, a "portion" is understood as a single area, or two or more separate and distinct areas on the surface 102 of the upper 101. In general, the portion whose property is changed may be arranged at arbitrary positions on the surface 102 of the upper 101.

As shown in detail in FIG. 3B, the inflatable elements 301 are connected to a module 302 containing a pneumatic valve as actuator 104. The connection is made via a hose 303. In these embodiments of FIGS. 3A, 3B and 4, the module 302 not only houses the pneumatic valve, but also the processing unit 106 and the sensor 105. Of course, the processing unit 106 and/or the sensor 105 could be arranged separate from the pneumatic valve 104 instead. Pressurized air is provided to the pneumatic valve by means of an air reservoir 304. The air reservoir 304 is connected to the pneumatic valve via a further hose 305. In these embodiments of FIGS. 3A, 3B and 4, pressurized air is provided to the air reservoir 304 by an air pump 306 which generates pressurized air through actions of a player wearing the shoe 100. Thus, as the player walks, runs, jumps, etc. the air reservoir 304 is filled with pressurized air. However, it must be noted, that instead of an air pump driven by the actions of a player, a miniaturized compressor driven e.g. by electric power could be used as well.

In these embodiments of FIGS. 3A, 3B and 4, the pneumatic valve in the module 302 is configured to provide pressurized air from the air reservoir 304 to the inflatable elements 301. As the elements 301 are inflated, the elements 301 show up through the elastic outer surface 102 of the upper 101. In this way, the at least one surface property of a portion of the outer surface 102 is changed.

The pressurized air may be released from the inflatable elements 301 by using e.g. a three-way valve. The inflatable elements 301 are connected to the middle port of the valve, which is connected to one of the side ports when the valve is in a first state and to the other side port when the valve is in a different, second state. The air reservoir 304 is connected to one side port and the other side port is left open, i.e. can be used for venting. Hence, the inflatable elements 301 may be pressurized with the valve in the first state, while the inflatable elements 301 vent in the other, second state of the valve.

In order to save battery power, a latched valve may be used. Thus, power has to be applied to the valve only during the switching between the different states of the valve.

FIG. 4 shows the arrangement of the above-mentioned mechanism 300 comprising the inflatable elements, the module, the hose, the air reservoir, the hose, and the air pump relative to the sole 103 of the shoe 100 in an exploded view. Thus, the air pump 306 is arranged between the heel portion of the sole 103 and the heel of a player wearing the shoe. In this position the energy of the actions of the player are best transformed into pressurized air provided by the pump 306. Different positions of the air pump 306 are possible as well, e.g. under the heel or toes.

As shown in FIG. 4, the module 302 is placed inside a cavity 401 of the sole 103 located under the arch of the food of the player. In this position the module 302 does not disturb the player and is protected from impacts. Different positions of the air pump 306 are possible as well, e.g. under the heel or toes.

A further exemplary mechanism 500 to change at least one surface property of a portion of the outer surface 102 of the upper by means of the actuator 104 is described with reference to FIGS. 5A, 5B and 6. Also in these embodiments, at least a portion of the outer surface 102 of the upper 101 is elastic. A plurality of pins 501 is arranged below the elastic portion of the outer surface 102 of the upper 101. An undulating structure 502 is arranged below the plurality of pins 501. The undulating structure 502 is connected to the actuator 104, such that the undulating structure 502 can be moved relative to the pins 501. In this way the pins 501 can be lowered or raised with respect to the outer surface 102. As the pins 501 are arranged below the elastic outer surface 102 of the upper 101, the surface structure of the outer surface 102 can be changed, i.e. buckles or elevations show up on the surface, when the pins 501 are raised.

A "pin" in the context of the present invention is understood as any structure that is able to change the surface properties by moving against the elastic outer surface. Thus, a pin may have the shape of a nib, a ball, a pyramid, a cube, etc.

The portion of the outer surface 102 of the upper 101 the property of which is changed may be arranged in the forefoot area, only on a medial side, only on the lateral side, on both sides, in the heel area, in the (medial and/or lateral) midfoot area, etc. The portion may also be arranged on any combination of the areas mentioned before. Thus, a "portion" is understood as a single area, or two or more separate and distinct areas on the surface 102 of the upper 101. In general, the portion whose property is changed may be arranged at arbitrary positions on the surface 102 of the upper 101.

Figure 5A:
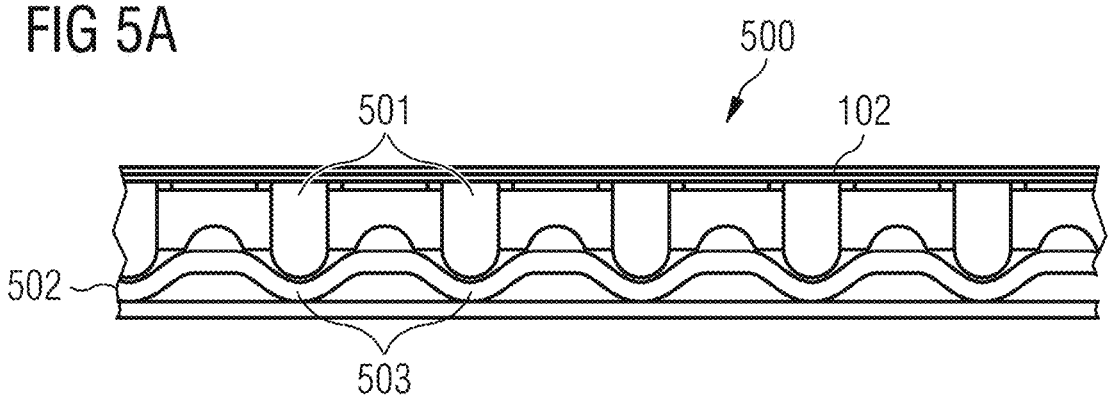
FIGS. 5A and 5B schematically depict a mechanism for changing a surface property using pins, according to certain embodiments of the present invention.
Figure 5B:
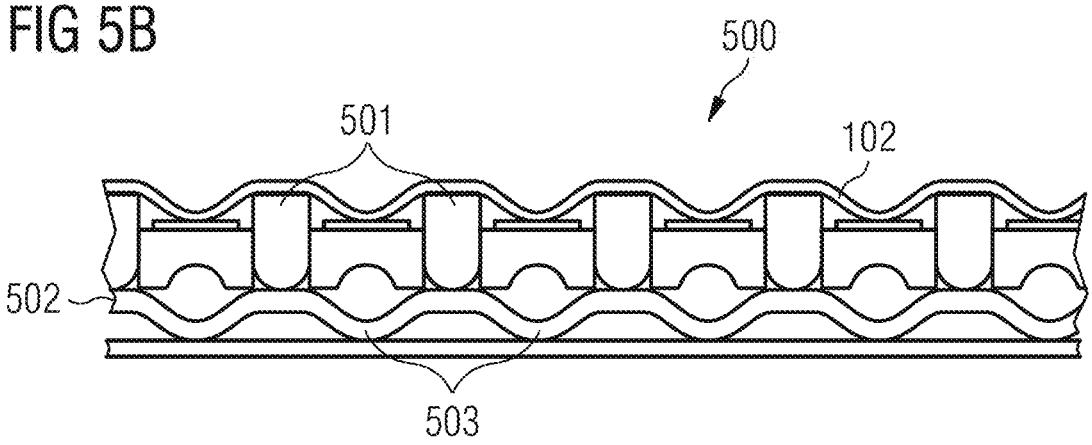

In FIG. 5A the pins 501 are shown in the lower position. In this position the pins 501 rest in dimples 503 of the undulating structure 502. As the actuator 104 moves the undulating structure 502 relative to the pins 501, the pins 501 are raised. Thus, in FIG. 5B, the pins 501 are shown in the upper position in which the dimples 503 of the undulating structure 502 have moved away from the pins 501.

Figure 6:
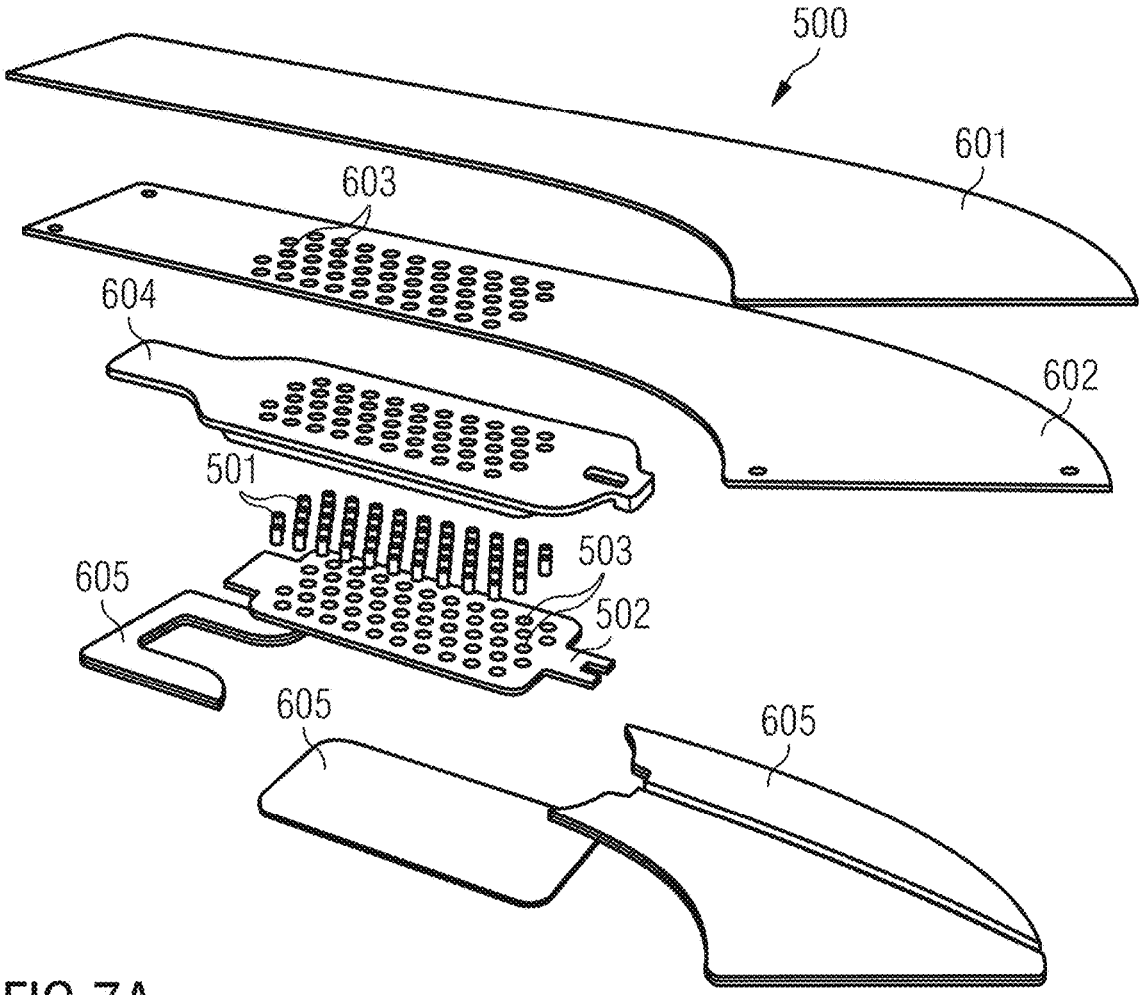
FIG. 6 is an exploded view of the mechanism of FIGS. 5A and 5B.

Certain embodiments of this mechanism are shown in FIG. 6. An elastic portion 601 of the outer surface 102 of the upper 101 is arranged on top of a mid-layer 602 comprising openings 603 for the pins 501. Below the mid-layer 602 a guide layer 604 is arranged. The guide layer 604 guides the pins 501 in a vertical direction. However, the guide layer 604 is optional and the mid-layer 602 would be sufficient to hold the pins 501 in place. Below the pins 501 the undulating structure 502 having dimples 503 is arranged. The undulating structure 502 is surrounded by a base layer 605. The operation of the mechanism shown in FIG. 6 has been described already with reference to FIGS. 5A and 5B.

Figure 7A:
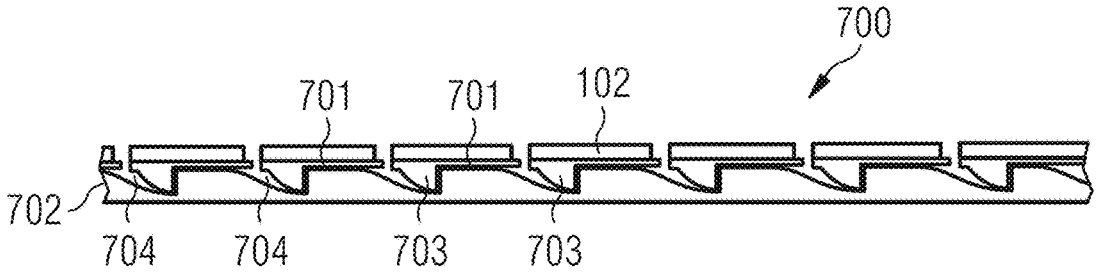
FIGS. 7A and 7B schematically depict a mechanism for changing a surface property using flaps, according to certain embodiments of the present invention.
Figure 7B:
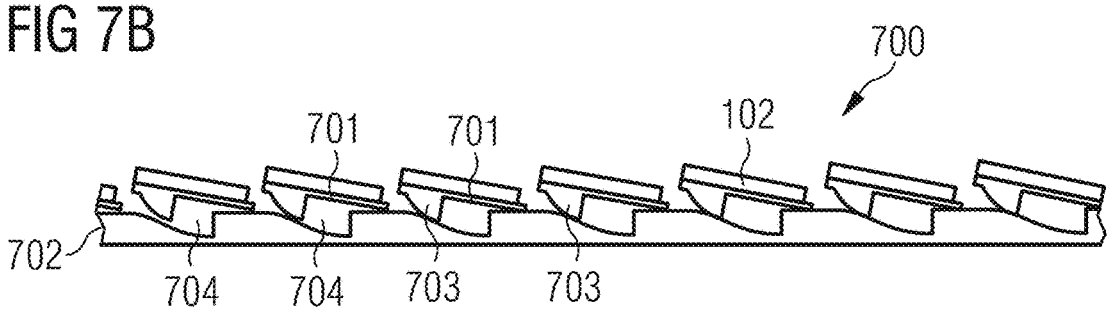

A further exemplary mechanism 700 to change at least one surface property of a portion of the outer surface 102 of the upper by means of the actuator 104 is described with reference to FIGS. 7A and 7B. In these embodiments, the outer surface 102 of the upper 101 comprises a plurality of flaps 701. The flaps 701 are adapted to be lowered or raised by means of the actuator 104 (not shown in FIGS. 7A and 7B). As can be seen in FIGS. 7A and 7B, a layer 702 with an undulating surface structure is arranged below the flaps 701. The undulating surface structure of the layer 702 is complementary to the structure of the flaps 701. When the actuator 104 either pulls or pushes the layer 702, the flaps 701 are either lowered or raised. As an option, a cover layer may be arranged above the outer surface 102.

The portion of the outer surface 102 of the upper 101 the property of which is changed may be arranged in the forefoot area, only on a medial side, only on the lateral side, on both sides, in the heel area, in the (medial and/or lateral) midfoot area, etc. The portion may also be arranged on any combination of the areas mentioned before. Thus, a "portion" is understood as a single area, or two or more separate and distinct areas on the surface 102 of the upper 101. In general, the portion whose property is changed may be arranged at arbitrary positions on the surface 102 of the upper 101.

In FIG. 7A the flaps 701 are in a lower position in which the heads 703 of the flaps 701 rest in corresponding recesses 704 of the layer 702 arranged below the flaps 701. In FIG. 7B the actuator 104 has moved the layer 702 relative to the flaps 701. Due to the undulating structure of the layer 702, the flaps 701 are now in a raised position. In this way, the surface structure of the outer surface 102 of the upper 101 can be changed.

The actuator 104 may be an electroactive polymer. Such polymers exhibit a shape change in response to electrical stimulation. For example, if a voltage is applied to such a polymer, the polymer may contract in the direction of the field lines and expand perpendicular to them. An electroactive polymer may be created by laminating thin films of dielectric elastomers on the front and back with carbon containing soft polymer films.

Figure 8A:
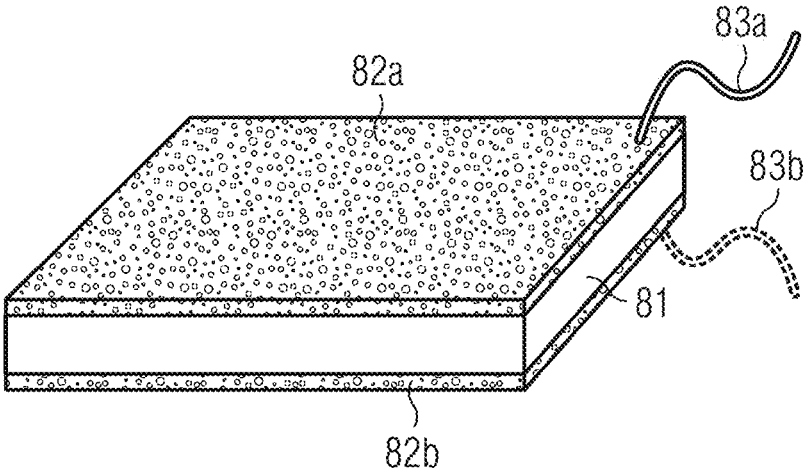
FIGS. 8A and 8B illustrate the principle of an electroactive polymer.
Figure 8B:
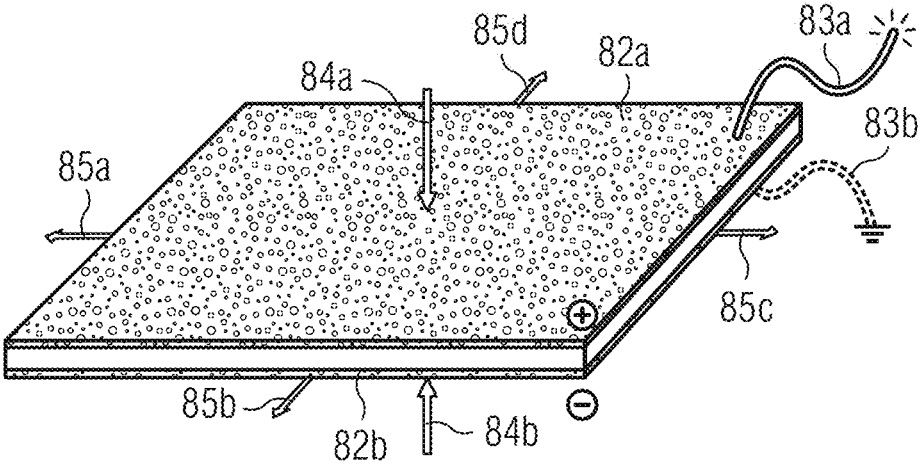

FIGS. 8A and 8B illustrate the principle of an electroactive polymer. The electroactive polymer in this example is a dielectric elastomeric film 81 which is covered by compliant electrodes 82*a* and 82*b* on the upper and lower side, respectively. The electrodes 82*a* and 82*b* allow the application of a voltage to the dielectric elastomeric film 81. To this end, wires 83*a* and 83*b*, respectively, are connected to the electrodes 82*a* and 82*b*. FIG. 8A shows the electroactive polymer in a state which no voltage applied.

In FIG. 8B a voltage V has been applied across the dielectric elastomeric film 81 via the wires 83*a* and 83*b* and the electrodes 82*a* and 82*b*. As illustrated in FIG. 8B, the thickness of the dielectric elastomeric film 81 is reduced as illustrated by arrows 84*a* and 84*b*, respectively. At the same time, the width and depth of the dielectric elastomeric film 81 is increased as illustrated by arrows 85*a*, 85*b*, 85*c* and 85*d*. The change in shape is caused by the applied voltage.

The main types of electroactive polymers which may be used in the context of the present invention include electronic electroactive polymers which are drive by an electric field, ionic electroactive polymers which involve mobility of ions, and nanotubes.

Electronic electroactive polymers can be divided in several sub-types, such as ferroelectric polymers, dielectric elastomers, electrorestrictive polymers and liquid crystal materials. The active principle of electronic electroactive polymers is based on an applied electric field which effects a shape change by acting directly on charges within the polymer. Electronic electroactive polymers exhibit a fast response, are efficient (down to 1.5 mW) and relatively insensitive to temperature and humidity fluctuations. They operate on high voltages and low currents.

The class ionic electroactive polymers comprises ionomeric polymer-metal composites, ionic polymer gels, conductive polymers and electrorheological fluids. The active principle of ionic electroactive polymers is based on an electrically driven mass transport of ions or electrically charged species which causes a shape change. Ionic electroactive polymers can exert a relatively high pressure and can be driven by low voltages.

Figure 9A:
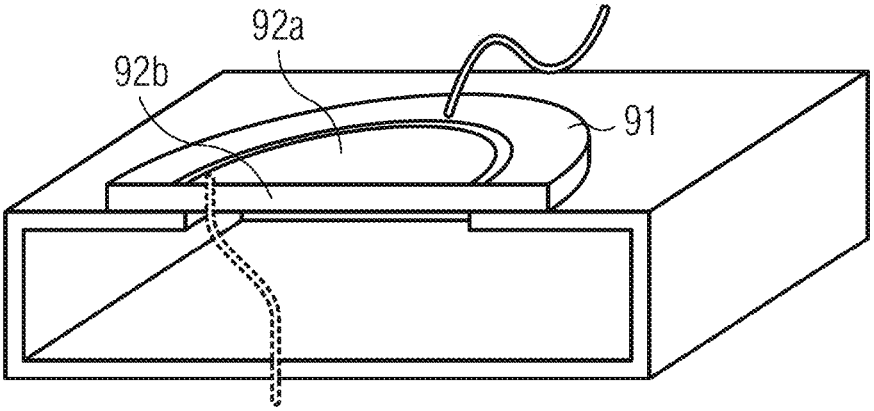
FIGS. 9A and 9B schematically illustrate an electroactive polymer, according to certain embodiments of the present invention.
Figure 9B:
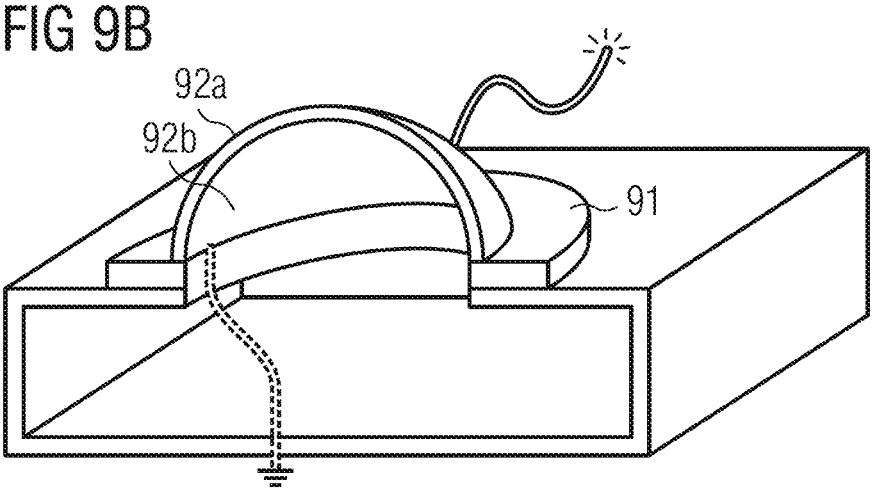

FIGS. 9A and 9B illustrate certain embodiments of an electroactive polymer which may be used in the context of the present invention, wherein FIG. 9A shows the inactive (i.e. without voltage applied) and FIG. 9B shows the active (i.e. with voltage applied) state of the electroactive polymer. The electroactive polymer is a thin film 91 which is coated by electrodes 92*a* and 92*b*, respectively. As shown in FIG. 9A, in the inactive state, the film 91 is in a flat configuration. If a voltage V is applied across the film 91 via the electrodes, the film 91 is flattened and increases its width and depth, i.e. its surface area, as described with respect to FIGS. 8A and 8B. Due the increased surface area, the film 91 buckles and acquires a hemisphere-like configuration. It would also possible that the film 91 have a different shape (e.g. cuboids, rectangle, . . . ), not shown. If the voltage is interrupted, the film 91 returns to the flat configuration shown in FIG. 9A.

Such an electroactive polymer 81 and 91 may be used in the context of the present invention as follows: At least a portion of the outer surface 102 of the upper 101 may be elastic and the electroactive polymer 81, 91 may be arranged below the elastic portion, such that a change of the shape of the electroactive polymer 81, 91 causes a change of the surface property of the elastic portion of the outer surface 102 of the upper 101. In this way, the surface property may be directly changed by the actuator 81, 91 without a further mechanism. The change in shape of the electroactive polymer 81, 91 may include a change in length, volume, thickness, width, surface area, modulus of elasticity and/or modulus of rigidity.

Figure 10:
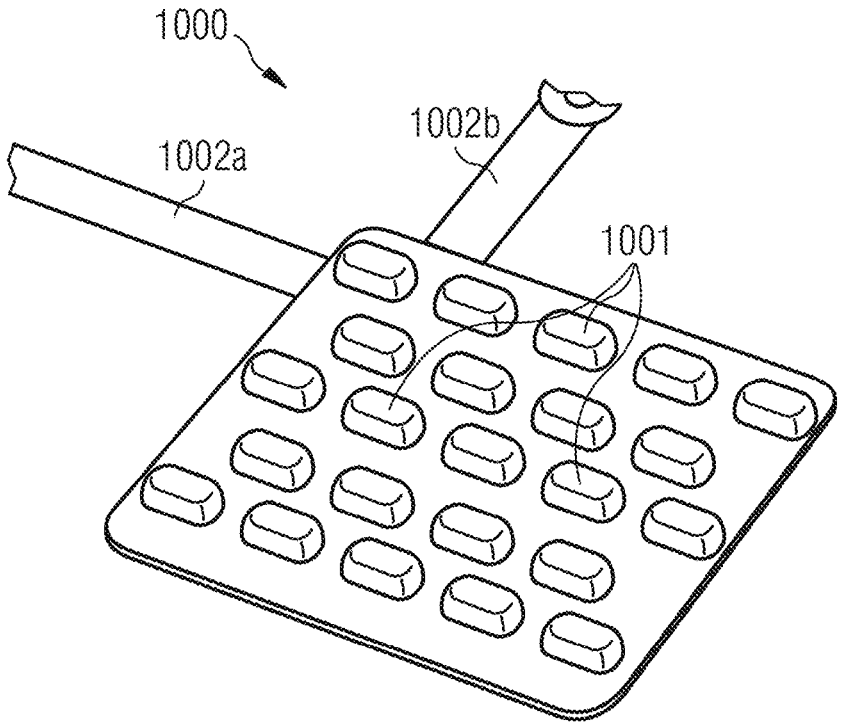
FIG. 10 is a perspective view of a module comprising electroactive polymers, according to certain embodiments of the present invention.

FIG. 10 shows a module 1000 comprising elastomeric polymers as described with respect to FIGS. 9A and 9B. The module is shown in the active state (voltage applied) in which the elastomeric polymers show up as bumps (i.e. small hemispheres) on the upper side of the module 1000. Three of those bumps are exemplarily denoted with the reference numeral 1001. In the inactive state, the bumps would disappear. The module 1000 also comprises wires 1002*a* and 1002*b*, respectively, to apply a voltage to the module 1000.

The module 1000 could for example be mounted under an elastic portion of an outer surface 102 of an upper 101. Thus, the bumps which are formed on the module would show up on the portion of the outer surface 102. In this way, surface properties, such as friction, surface area and surface structure can be easily changed by means of the module 1000 and the elastomeric polymers therein which act as actuators.

Electroactive polymers may also cause a change of a surface property of the portion of the outer surface 102 of the upper 101 indirectly. To this end an electroactive polymer, such as the polymers 81 and 91 shown in FIGS. 8A, 8B and 9A, 9B, respectively, could be coupled to a mechanism, such that the electroactive polymer may change the surface property of a portion of the outer surface 102 of the upper 101 via the mechanism. The mechanism may be a mechanism as described in detail herein, i.e. pins, flaps and/or fins, etc.

Figure 11:
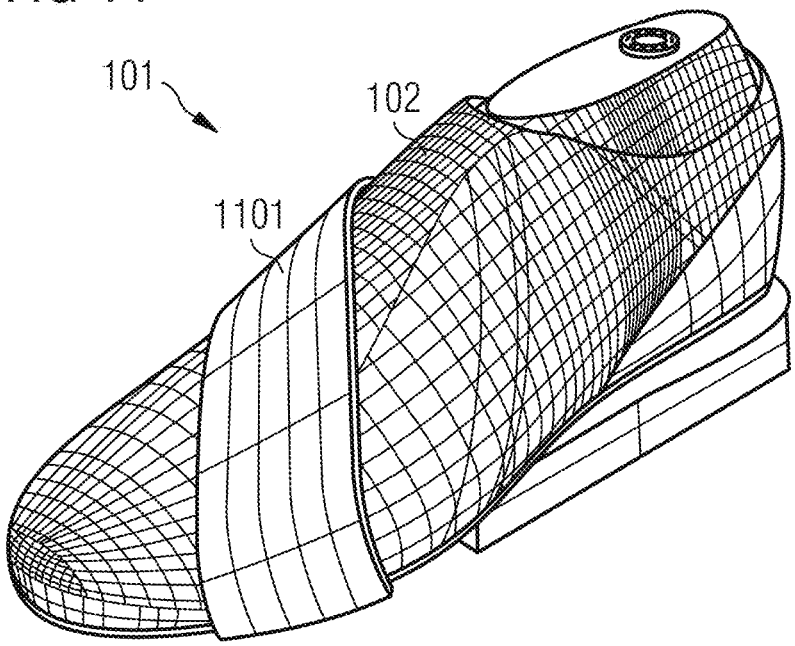
FIG. 11 is a perspective view of a portion of the outer surface of the upper with changeable surface property, according to certain embodiments of the present invention.

FIG. 11 illustrates an exemplary arrangement of a portion 1101 of the outer surface 102 of the upper 101 at least one property of which is changed according to the invention. As shown in FIG. 11, the portion 1101 runs from the lateral side of the shoe near the toes over the instep to the medial side near the arch of the foot. This arrangement may be desirable for full and half instep kicks, which are most important in ball sports such as soccer, American football and rugby. Under the portion 1101 shown in FIG. 11, one of the exemplary mechanisms described above can be arranged.

However, the portion of the outer surface 102 of the upper 101 the property of which is changed may also be arranged in the forefoot area, only on a medial side, only on the lateral side, on both sides, in the heel area, in the (medial and/or lateral) midfoot area, etc. The portion may also be arranged on any combination of the areas mentioned before. Thus, a "portion" is understood as a single area, or two or more separate and distinct areas on the surface 102 of the upper 101. In general, the portion whose property is changed may be arranged at arbitrary positions on the surface 102 of the upper 101.

In the following, an exemplary method of how to detect a predetermined event in the data provided by the sensor 105 causing the processing unit 106 to instruct the actuator 104 to change at least one surface property of a portion of the outer surface 102 of the upper 101 is described.

Figure 12:
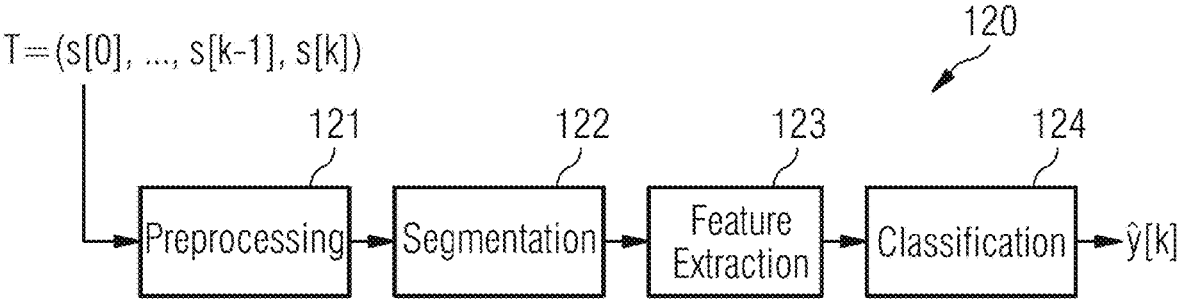
FIG. 12 is an illustration of a method to detect an event, according to certain embodiments of the present invention.

A general overview of such a method 120 is shown in FIG. 12. In a first method step 121, the raw sensor data is preprocessed for noise reduction and computational efficiency, i.e. signal processing methods like low pass filters and decimation are applied. In a second method step 122, the time series is divided into segments. In a third method step 123 features are extracted from the segmented time-series. In a fourth method step 124, the extracted features are classified to detect an event.

The time-series may be preprocessed by digital filtering using for example a nonrecursive moving average filter, a Cascade Integrator Comb ("CIC") filter or a filter bank.

The sensor data can be written as a time-series T=(s[0], . . . , s[k−1], s[k]), where s denotes the signal amplitude of one sensor axis at past sampling points and k indicates the latest sampling point.

Figure 13:
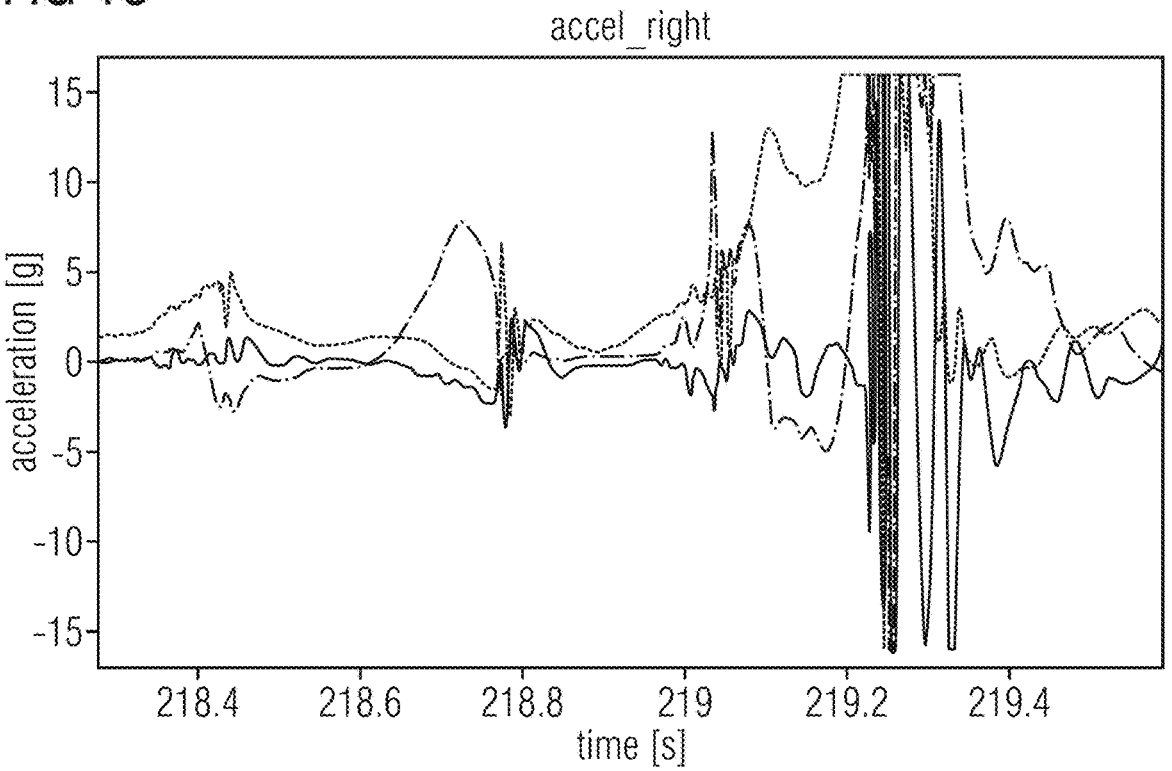
FIG. 13 is a plot of a time-series obtained from a 3-axis accelerometer, according to certain embodiments of the present invention.

An exemplary time-series obtained from a 3-axis accelerometer is shown in FIG. 13. In this plot the abscissa refers to the time in seconds, whereas the ordinate refers to the acceleration measured in units of the earth's gravitational acceleration g. The plot shows the temporal evolution of the acceleration in all three dimensions (three axes). This exemplary time-series was obtained by an accelerometer placed inside a soccer shoe while the soccer player wearing the shoe was making an instep kick.

Figure 14:
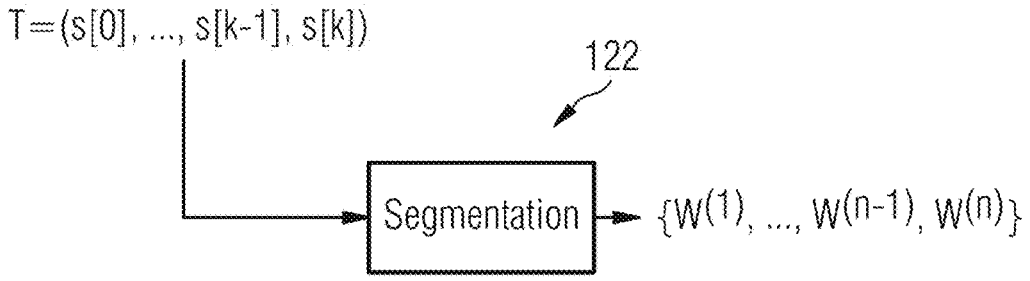
FIG. 14 is an illustration of a segmentation of a time-series in windows, according to certain embodiments of the present invention.

After the time-series of sensor data has been retrieved and preprocessed in method step 121, the time-series is segmented in windows in method step 122 as shown in FIG. 14. The windows are defined as $W=(s[k_1], \ldots, s[k_2])$, where $k_1$ and $k_2$ determine its boundaries. The windows segmented from time-series Tare indicated by 1, . . . , n, $\{W^{(1)}, \ldots, W^{(n-1)}, W^{(n)}\}$ as shown in FIG. 14.

Figure 15:
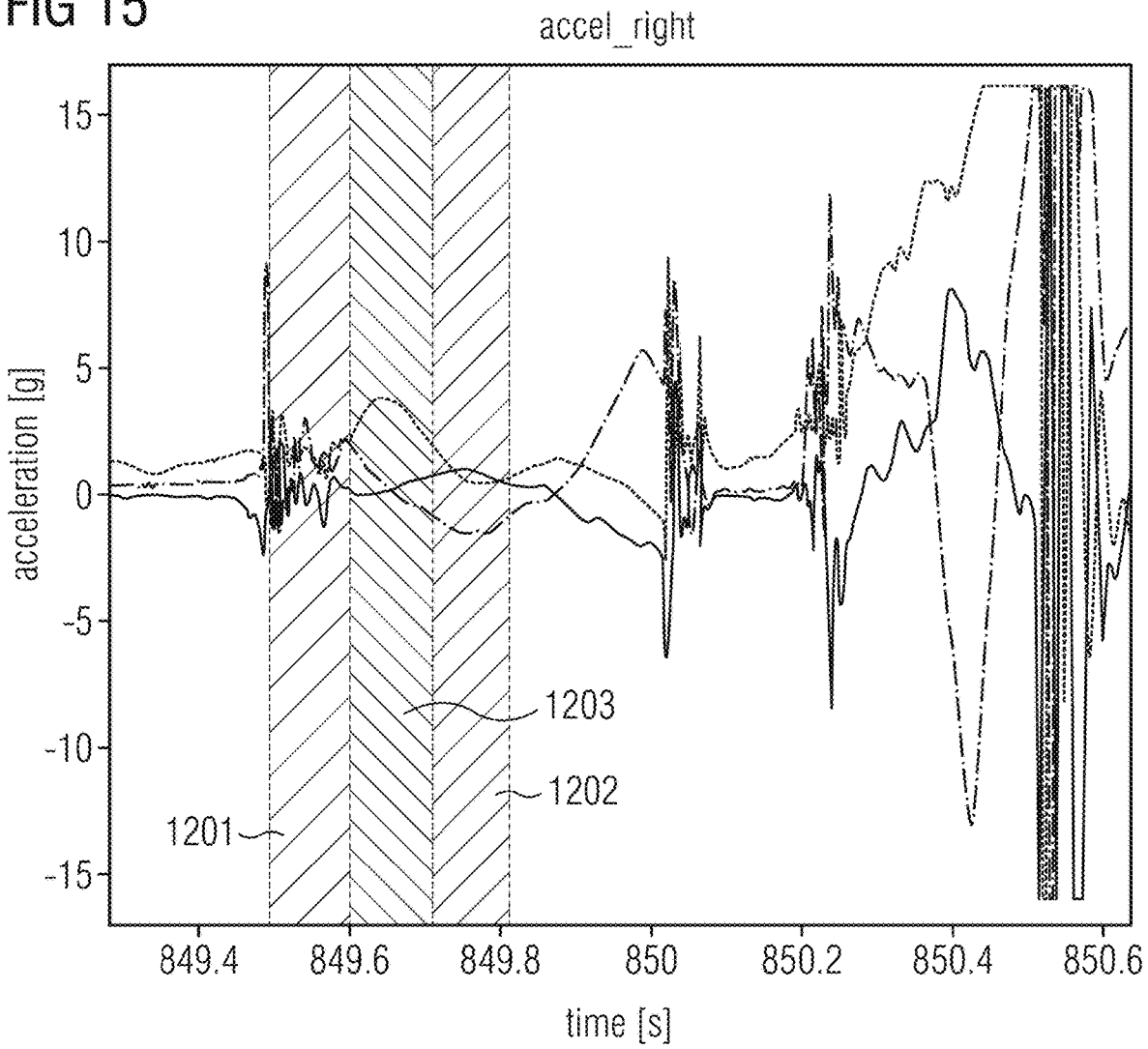
FIG. 15 depicts an exemplary result of a segmentation step, according to certain embodiments of the present invention.

An exemplary result of a segmentation step 122 is shown in FIG. 15. Two exemplary windows 151 and 152 obtained by the segmentation step 122 are depicted. The exemplary windows 151 and 152 have a duration of approximately 210 ms. In general, the segmented windows of the time-series may have any duration which is suitable for the application at hand, for example 10 to 1000 ms, preferably 210 ms in a soccer application. However, if the window size is chosen too small the computation of significant, global features is hardly possible. In contrast, if the window size is too long a real-time computing until a certain timestamp will be more difficult.

The exemplary windows 151 and 152 in FIG. 15 overlap by 50%. The overlapping area is denoted with the reference numeral 153. The segmenting 122 of the time-series shown in FIG. 15 is based on a sliding window which has a fixed size and overlap ratio. Instead of such a sliding window segmentation, a segmentation can be used which is based on a certain condition present in the time-series. For example, the condition may be the crossing of the sensor data of a defined threshold. If the threshold is exceeded in either direction, the window starts and ends at the next crossing. A minimum and maximum window length can be set to omit irrelevant data and to reduce computational effort. An exemplary minimum window length is 50 ms and an exemplary maximum window length is 300 ms. Additionally, a threshold of minimum acceleration can lead to a lower number of irrelevant windows which do not belong to the event to be detected. Thus, the limits of the threshold-based window are determined by the forward and backward acceleration of the body or part of the body, for example of a kicking foot. The time-series may also be segmented in a plurality of windows based using matching with a template of an event that is defined using known signals of pre-recorded events. The matching may be based on correlation, Matched Filtering, Dynamic Time Warping, or Longest Common Subsequence ("LCSS") and its sliding window variant, warping LCSS.

Figure 16:
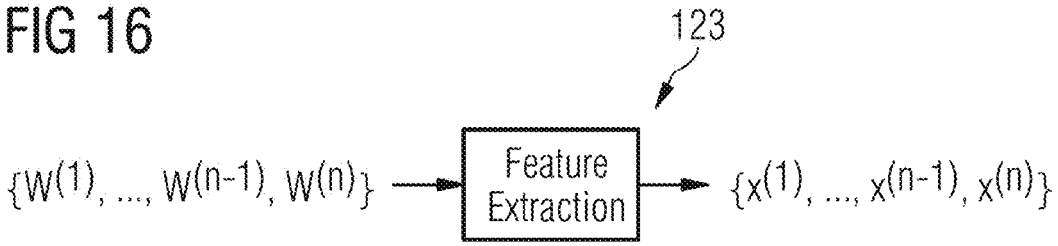
FIG. 16 is an illustration of a method step of feature extraction, according to certain embodiments of the present invention.

The next step as shown in FIG. 12 is feature extraction 930. In this step 930 a plurality of features from the sensor data in each of the windows is extracted. Features (also denoted as characteristic variables) are extracted to represent the particular window in a lower dimension as shown in FIG. 16. Thus, a feature vector x containing feature values in F dimensions is computed from every window 1, . . . , n:$x^{(n)}=f(W^{(n)})$, wherein f(.) is a multidimensional function.

The extracted features may for example be based on at least one of temporal statistics, spatio-temporal statistics, spectral, or ensemble statistics by applying, for example, wavelet transform, principal component analysis (PCA), coefficients of a Linear Predictive Coder ("LPC"), coefficients (e.g. spectral centroid and bandwidth) of a Fast Fourier Transform ("FFT"). Other features may be used as well. Selected features are explained below.

Human motion has limited degrees of freedom analogous to human joints, leading to redundant observations of multiple sensor axes. For example, body axes are related while moving backwards for initiating a kick. The linear relationship between sensor axes, i.e. different dimensions of observations, can be measured by the sample correlation. The correlation coefficient between two sensor axes can be estimated by the Pearson correlation coefficient.

The sample mean of a window is defined by averaging the data samples in one dimension, i.e. the data associated with one sensor axis. Moreover, the signal energy gives evidence of the movement intensity. Human events can thus be analyzed by reflecting the intensity: for example in soccer, the kicking event is presumed to have higher power than other events like short passes or dribbling actions. The signal energy in one observation window in dimension d (i.e. sensor axis d) is evaluated by $$E_d = \frac{1}{K}\sum_{k=0}^{K-1}(s_d[k])^2,$$

wherein the length of the window is denoted by K.

To capture the overall intensity of human motion, the Movement Intensity, MI, is introduced as accumulation of the normalized energies over all dimensions D:

$$MI = \frac{1}{D}\sum_{d=1}^{D}E_d.$$

In addition, the normalized Signal Magnitude Area, SMA, is defined as $$SMA = \frac{1}{KD}\sum_{k=0}^{K-1}\sum_{d=1}^{D}|s_d[k]|,$$

by adding up the absolute values $|s_d[k]|$. Higher-order statistics like kurtosis and skewness can be used as well.

In addition or alternatively, spatio-temporal features such as minimum and maximum values along the dimensions of the window Wcan capture information of intense peaks in the signal. Thus, exemplary temporal and spatio-temporal statistics include sample mean, normalized signal energy, movement intensity, signal magnitude area, correlation between axes, maximum value in a window and minimum value in a window.

In addition or alternatively to temporal or spatio-temporal statistics, wavelet analysis may be used for feature extraction 130 as well. Wavelet analysis can characterize non-stationary signals, whose spectral statistics changes over time. Moreover, it has the property of reflecting transient events as it captures temporal and spectral features of a signal simultaneously. Wavelet transform is performed using a single prototype function called wavelet which is equivalent to a band-pass filter. Multi-scaled versions of the wavelet are convolved with the signal to extract its high-/low-frequency components by a contracted/deleted version of the wavelet. Given a window of sensor data observations, multi-resolution analysis in time-frequency domain is performed by dilating the basis wavelet. The wavelet transform offers superior temporal resolution of the high-frequency components and a superior frequency resolution of the low-frequency components. Details of wavelet analysis can be found in Martin Vetterli and Cormac Herley, "Wavelets and filter banks: Theory and design", *IEEE Transactions on Signal Processing,* 40(9): 2207-2232, 1992.

Figure 17:
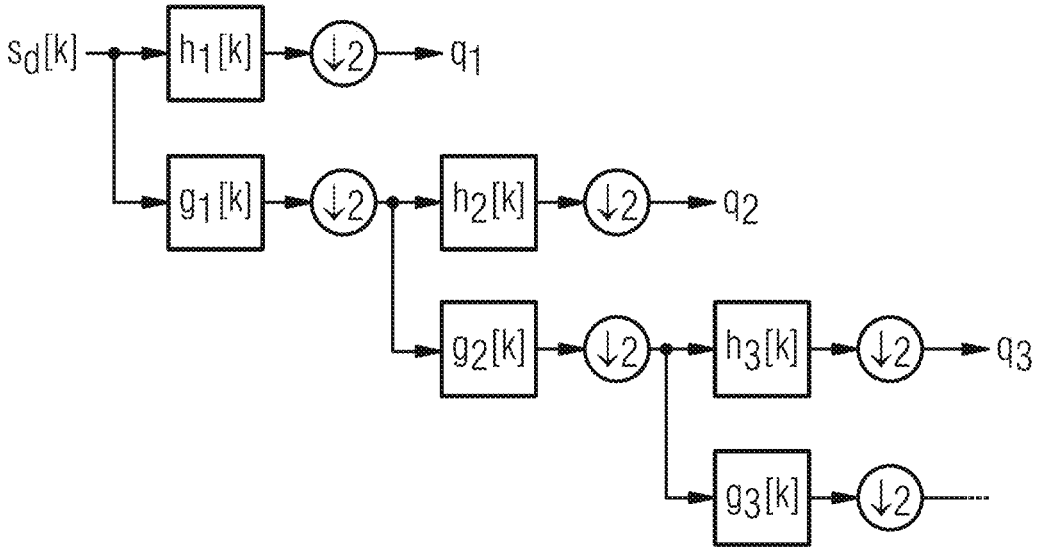
FIG. 17 is a diagram representing an implementation of a Fast Wavelet Transform, according to certain embodiments of the present invention.

Discrete Wavelet Transform can be used to capture the characteristics of human motion. It can be implemented efficiently as fast wavelet transform. It is represented by a filter bank decomposing the signal by a series of low-pass and high-pass filters as shown in FIG. 17. At each level i the input signal s[k] is filtered by a low-pass filter $g_i[k]$ and a high-pass filter $h_i[k]$. In subsequent levels, the low-pass filtered signal is successively decomposed into lower resolution by down sampling it by a factor of two, whereas detail coefficients q, can be extracted from the high-pass filtered signal and can be used as a feature of the respective window. If the high-pass signal is decomposed equally the transformation is called Wavelet Packet Decomposition. Details of the Discrete Wavelet Transform to capture details of human motion can be found in Martin Vetterli and Cormac Herley, "Wavelets and filter banks: Theory and design", *IEEE Transactions on Signal Processing,* 40(9): 2207-2232, 1992.

Daubechies wavelets can be used in the context of the present invention, because they can be implemented computationally efficiently. For example, a Daubechies wavelet of order seven can be used for feature extraction.

In addition to temporal, spatio-temporal and spectral analysis, ensemble statistics of observations of human events provide a less complex representation of the recorded data. Acquired windows belonging to specified movements can serve for template generation. In the d-th dimension, a vector of an observed window $W^{(n)}$ is built according to $w_d^{(n)}=[s_d^{(n)}[0], s_d^{(n)}[1], \ldots, s_d^{(n)}[k-1]]^T$. From now on, the dimension index d is omitted due to readability. Collecting all windows $W^{(n)}$ with $n\in\{1, \ldots, N\}$ of one event, the average over all observations N can serve as a template $\tau$:

$$\tau = [\tau[0], \tau[1], \ldots, \tau[k-1]]^T = \frac{1}{N}\sum_{n=1}^{N}w^{(n)}.$$

Template matching methods measure the similarity between windows of observation and templates, for example by computing the Pearson correlation coefficient. Each observation n differs from the template by the vector $\phi^{(n)}=w^{(n)}-\tau$. After subtracting $\tau$, second-order statistics can be applied by computing the sample covariance matrix COV of all observations belonging to the same event:

$$COV = \frac{1}{N}\sum_{n=1}^{N}(\phi^{(n)})(\phi^{(n)})^T = \frac{1}{N}\Phi\Phi^T,$$

where the matrix $\Phi$ is spanned by the centered observations $\Phi=[\phi^{(1)}, \phi^{(2)}, \ldots \phi^{(N)}]$. The principal components (PCs) of the matrix $\Phi$ give evidence of the main directions of W deviation for all realizations by solving $\Phi\Phi^T v_m=\mu_m v_m$, where $\mu_m$ refers to the m-th eigenvalue belonging to the eigenvector $v_m$ of $\Phi\Phi^T$ with $m\in\{1, \ldots, N\}$(full rank).

This is equivalent to computing the eigenvectors of the centered covariance matrix COV. The principal components belonging to the M largest eigenvalues $\mu_1>\mu_m>\mu_M$ can be used for feature extraction. Every dimension of a window W belonging to a specific event can be represented as linear combination of the corresponding principal components of the same event computed from previous observations:

$$w \approx \sum_{m=1}^{M}\omega_m v_m,$$

where the coefficients $\omega_m$ are computed by the projection onto the principal components: $\omega_m=v_m^T\phi$. The coefficients $\omega_m$ can be considered as features for the subsequent classification step 140 in FIG. 12.

Furthermore, for window W, the Euclidean distance e to the reduced eigenspace $\{v_1, \ldots, v_m\}$ is given by:

$$\varepsilon = \left\| w - \sum_{m=1}^{M} \omega_m v_m \right\|_2 .$$

For windows that emerged from the same event as the computed principal components, the Euclidean distance is presumed to be higher than for windows of a different event. Therefore, the distance e to the reduced eigenspace can be used as a feature as well.

Thus, a plurality of features can be extracted based on temporal, spatio-temporal, spectral, or ensemble statistics by applying Wavelet Analysis, Principal Component Analysis and the like. Exemplary features include sample mean, normalized signal energy $E_d$, movement intensity (MI), signal magnitude area (SMA), correlation between axes, maximum value in a window, minimum value in a window, maximum detail coefficient $q_i$ at level l obtained by a wavelet transform, correlation with template $\tau$, projection $\omega_m$ onto m-th principal component of template $\tau$, distance e to eigenspace of template T.

Given a feature set of all extracted features, the most relevant and nonredundant features should be selected to reduce the complexity of the implementation of the method. Any redundancy between features can result in unnecessarily increased computational costs. Simultaneously, this subset of features should yield the best classification performance. One can discriminate between different selection techniques: wrapper methods, selection filters and embedded approaches.

Wrapper methods evaluate the performance of the method according to the invention using different feature subsets. For example, sequential forward selection adds the best performing features iteratively.

Selection filters are a fast method to find the most important features as no classifier is involved in the selection procedure. The mutual information can indicate the relevance of feature subsets and can be estimated by different filter techniques.

Finally, an embedded selection can be used to avoid the exhaustive search by wrapper methods and the estimation of probability density functions by selection filters. Embedded selection is reasonable as some classifiers used in method step 124 already include a rating of the feature importance.

For example, Random Forest classifiers can be used for feature selection. A Random Forest can be described as an ensemble of decision tree classifiers, growing by randomly choosing features of the training data. For each tree, a subset of training data is drawn from the whole training set with replacement (bootstrapping). Within this subset, features are chosen randomly and thresholds are built with their values at each splitting node of the decision tree. During classification, each tree decides for the most probable class of an observed feature vector and the outputs of all trees are merged. The class with the most votes is the final output of the classifier (majority voting). Details of Random Forest classifiers can be found in Leo Breiman, "Random forests", *Machine learning,* 45(1):5-32, 2001.

As shown in FIG. 12, in the next step 124 of the method according to the invention, an event class associated with each of the windows based on the plurality of features extracted from the sensor data in the respective window is estimated. This step is also referred to as classification.

Figure 18:
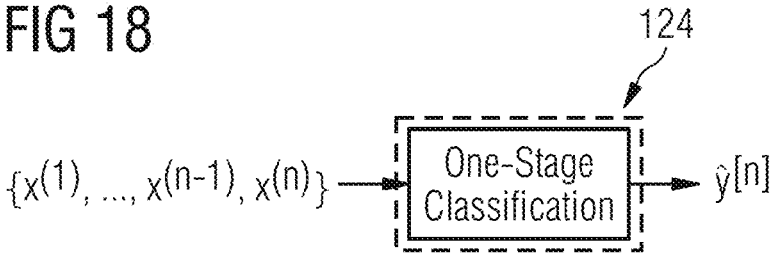
FIG. 18 is an illustration of a one-stage classification, according to certain embodiments of the present invention.

Classification may be performed in one stage or in multiple stages. In the following, one-stage classification and a two-stage classification scheme are described. FIG. 18 depicts an exemplary one-stage classification at a time instance n given feature vectors x. The classification step 124 maps the feature vectors $\{x^{(1)}, \ldots, x^{(n-1)}, x^{(n)}\}$ to an estimated event class $\hat{y}^{(n)}$ at time instance n. The set of labels indicating the event class may for example be given by Y={0,1}, where y=1 refers to a kick event (in an exemplary soccer application) and y=0 refers to the NULL class, i.e. all events not being a kick event. Another exemplary set of labels indicating the event class may be given by Y={SP, CO,LP,ST,NULL}, where "SP" refers to a short pass, "CO" refers to control, "LP" refers to long pass, "ST" refers to shot, and "NULL" refers to the NULL class containing instances of e.g. jogging, running or tackling. Thus, in the latter example the event classification is more fine-grained and does not only allow to identify a kick, but also the type of kick, i.e. short pass, control, long pass, shot.

Thus, method step 124 estimates the label to be associated with the feature vectors $\{x^{(1)}, \ldots, x^{(n-1)}, x^{(n)}\}$ of the respective windows $\{W^{(1)}, \ldots, W^{(n-1)}, W^{(n)}\}$. Assuming an optimal segmentation, i.e. that every window W belongs only to one event class, the event class can be estimated by the maximum of the conditional probability density function:

$$\hat{y}^{(n)} = \underset{y^{(n)} \in Y}{\arg\max}\, p\left(y^{(n)} \,\middle|\, x^{(1)}, \ldots, x^{(n)}\right).$$

It is assumed that event $y^{(n)}$ has a finite duration of v windows and is statistically independent from previous feature vectors $\{x^{(1)}, \ldots, x^{(n-v)}\}$. Given this constraint, the conditional probability density function in the previous equation equals $p(y^{(n)}|x^{(1)}, \ldots, x^{(n-1)}, x^{(n)})=p(y^{(n)}|x^{(n-v+1)}, \ldots, x^{(n)})$. Thus, the estimation only involves the last v feature vectors:

$$\hat{y}^{(n)} = \underset{y^{(n)} \in Y}{\arg\max}\, p\left(y^{(n)} \,\middle|\, x^{(n-v+1)}, \ldots, x^{(n)}\right).$$

Therefore, the feature vectors are merged in a combined feature vector $\tilde{x}^{(n)}=\mathrm{vec}([x^{(n-v+1)}, \ldots, x^{(n)}])$, where the vec(.) operator generates a column vector from a matrix by sticking the column vectors below one another. The labeling of events $y^{(n)}$ is modified to:

$$\tilde{y}^{(n)} = \begin{cases} 1, \text{ if } y^{(n-v+1)} = 1 \wedge \ \ldots \ \wedge y^{(n)} = 1 \\ 0, \text{ if } y^{(n-v+1)} = 0 \vee \ \ldots \ \vee y^{(n)} = 0 \end{cases}.$$

In case of multiple events to be estimated (for example the exemplary set of events Y={SP,CO,LP,ST,NULL}) this labeling is modified accordingly.

This means that only the last segment (n) of the event to be estimated (for example a kick event) is indicated by $\tilde{y}^{(n)}=1$. If the event to be estimated is not observed completely, $\tilde{x}^{(n)}$ is assigned to the NULL class, $\tilde{y}^{(n)}=0$. Thus, by dropping the time indices(n) the estimation is given by $$\hat{y} = \underset{\tilde{y} \in Y}{\mathrm{argmax}}(\tilde{y} \,|\, \tilde{x}).$$

In the following, three classifiers estimating $\tilde{y}$ are described referred to as one-stage classifiers. The considered classifiers are Naïve Bayes, Support Vector Machine and Random Forest. However, other classifiers, such as AdaBoost classifier, a Nearest Neighbor classifier, a Neural Network classifier, a Perceptron classifier, a Rule based classifier, a Tree based classifier can be used for this purpose, too.

In the Naïve Bayes approach, the posterior probability density function can be written as $$p(\tilde{y} \mid \tilde{x}) = \frac{p(\tilde{y})p(\tilde{x} \mid \tilde{y})}{p(\tilde{x})}$$

applying the Bayesian formula. Instead of maximizing the posterior probability density function, the class conditional probability density function $p(\tilde{x}|\tilde{y})$ can be maximized to estimate the class $\tilde{y}$:

$$\hat{y} = \underset{\tilde{y} \in Y}{\operatorname{argmax}}\, p(\tilde{y} \mid \tilde{x}) = \underset{\tilde{y} \in Y}{\operatorname{argmax}}\, p(\tilde{y})p(\tilde{x} \mid \tilde{y}).$$

Naïve Bayes classification solves this equation under the assumption that all components of feature vector $\tilde{x}$ are mutually independent. This leads to the simplification:

$$\hat{y} = \underset{\tilde{y} \in Y}{\operatorname{argmax}}\, p(\tilde{y}) \prod_{f=1}^{vF} p(\tilde{x}_f \mid \tilde{y})$$

The class conditional probability density functions, observing feature $\tilde{x}_f$ given the class $\tilde{y}$, are assumed to be Gaussian probability density functions: $p(\tilde{x}_f|\tilde{y}) \sim N(\tilde{x}_f; \mu_f, \sigma_f^2)$. Thus the probability density functions are only defined by their means $\mu_f$ and variances $\sigma_f^2$.

Given a training dataset $D=\{(\tilde{y}^{(1)}, \tilde{x}^{(1)}), \ldots, (\tilde{y}^{(N)}, \tilde{x}^{(N)})\}$, the probability density functions $p(\tilde{x}_f|\tilde{y})$ are determined. This is done by maximum likelihood estimation of the mean values $\mu_f$ and $\sigma_f^2$. In addition, the prior probability density function $p(\tilde{y})$ is defined with regard to the costs of misclassifications. For example, the probability $p(\tilde{y}=1)$(assuming the above example of estimating a single event like a kick event) may be assumed to be greater than $p(\tilde{y}=0)$, because the costs for missing the kick event should be higher than for classifying the kick event instead of the NULL class. Of course, the approach described above can be applied to different distributions for the probability density functions, such as Student's t-distribution, Rayleigh distributions, Exponential distributions, and the like. Furthermore, instead of maximum-likelihood estimation of the parameters of the underlying probability density function, a different approach may be used as well.

Now, given an unlabeled feature vector $\tilde{x}^{(n)}$ at time instance n in method step 124, the Gaussian distributions $p(\tilde{x}_f^{(n)}|\tilde{y})$ are evaluated for each class $\tilde{y} \in Y$ at each feature value of $\tilde{x}^{(n)}$. Then, the class is estimated by the equation derived above:

$$\hat{y} = \underset{\tilde{y} \in Y}{\operatorname{argmax}}\, p(\tilde{y}) \prod_{f=1}^{vF} p(\tilde{x}_f \mid \tilde{y})$$

to obtain $\hat{y}^{(n)}$. In this way, the event class can be estimated in method step 124 based on a Naïve Bayes classifier. An overview of the Naïve Bayes approach for classification can be found in Sergios Theodoridis and Konstantinos Koutroumbas, *Pattern Recognition,* $4^{th}$ edition, Elsevier, 2008.

Figure 19:
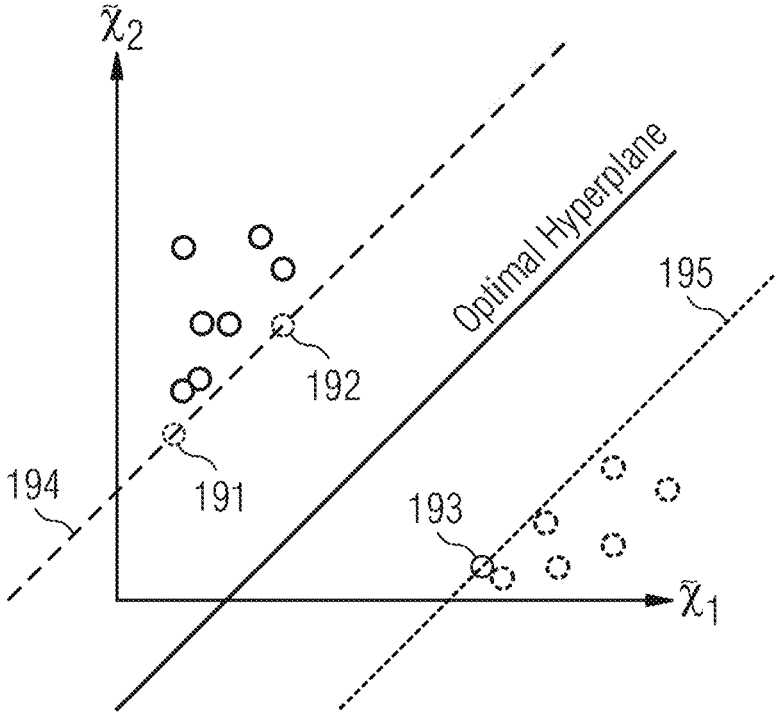
FIG. 19 is an illustration of a Support Vector Machine, according to certain embodiments of the present invention.

Another classifier which may be used in method step 124 is based on a Support Vector Machine ("SVM"). SVMs focus directly on the class boundaries, i.e. in the case of linear SVM on the class boundaries in the original feature space. The feature space is defined as the mapping of the feature vectors in a multidimensional system, where each dimension of the feature vector corresponds to one coordinate axis. The concept is to find the largest linear margin between the feature vectors of two classes as illustrated in FIG. 19. In this case, the two-dimensional feature sets are linearly separable. The feature vectors 191, 192 and 193 lying on the margins 194 and 195, called support vectors, define the optimal hyper-plane.

Given a training dataset D, the feature vectors of the event or the events to be estimated and the NULL class are analyzed in the feature space. A maximum margin is found by the SVM, separating the classes with a maximum distance. This distance equals the maximum distance between the convex hulls of the feature sets. Apart from using a linear kernel, other kernel types can be applied, e.g. polynomial or radial basis function ("RBF"). A detailed description can be found e.g. in Richard O. Duda, Peter E. Hart and David G. Stork, "Pattern Classification", $2^{nd}$ edition, John Wiley & Sons, 2000.

For the SVM a soft margin model can be used that allows training errors, i.e. outliers lying on the wrong side of the margin. These errors are caused by non-linear separable feature sets. Within the optimization problem the outliers of a classy are punished by costs. For example, the costs of the event or the events to be estimated can be set higher than the costs of the NULL class to reduce the number of non-detected events. The optimal hyper-plane is shifted towards the feature set of the classy with lower costs. The support vectors defining the hyper-plane are stored for the classification procedure.

Now, given an unlabeled feature vector $\tilde{x}^{(n)}$ at time instance n in method step 124, it is analyzed in the feature space. The distance and the location with respect to the separating hyper-plane gives evidence about the posterior probabilities. However, the probabilities are not provided directly as only distances are measured. The location with respect to the linear decision boundary corresponds to the most probable class and is used as estimate $\hat{y}^{(n)}$. In the case of more than one event to be determined, the distance vectors to several hyper-planes separating the feature space have to be considered.

A further approach which may be used in method step 124 is based on Random Forests. As mentioned already, a Random Forest involves an ensemble of decision tree classifiers, which are growing by randomly choosing features from the training dataset.

Given a training dataset D, the trees can be built as described e.g. in Trevor Hastie, Robert Tibshirani, Jerome Friedman, "The elements of statistical learning", volume 2, Springer 2009. For every tree a subset of data is drawn from the training dataset with replacement (bootstrap data). Then, each tree is grown from the bootstrap data by recursively repeating the following steps until the minimum node size is reached: firstly, a subset of features is selected randomly. Secondly, among the subset, the feature providing the best splitting between classes is picked to build the threshold at the current node. The chosen feature is omitted for the next iteration. Thirdly, this node is split into daughter nodes.

Now, given an unlabeled feature vector $\tilde{x}^{(n)}$ at time instance n in method step 124, the class $\tilde{y}^{(n)}$ is estimated according to the estimated class of all trees. The class with the majority of votes corresponds to the estimate of the Random Forest $\hat{y}^{(n)}$.

Figure 20:
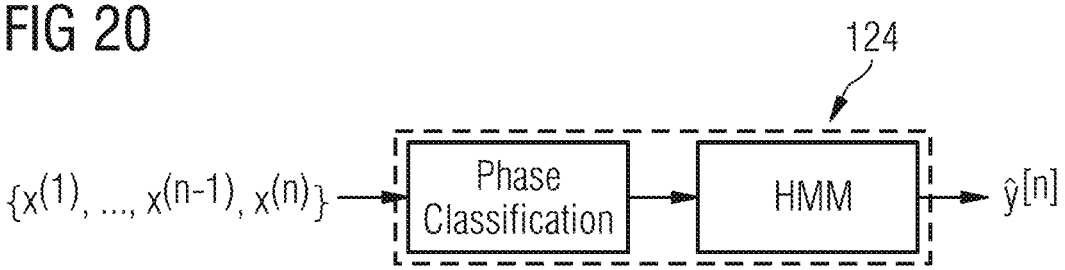
FIG. 20 is an illustration of a two-stage classification, according to certain embodiments of the present invention.

Instead of a one-stage classifier as described above, a two-stage classifier for estimating $\hat{y}$ can be used which is described in the following. This two-stage approach enables the estimation of an event before it is finished and all v windows are observed. Therefore, it may be desirable for use with real-time applications (online processing). As shown in FIG. 20, the two stages of this approach are a phase classification followed by a sequential modeling by Hidden Markov Models ("HMM"). Essentially, the sequential behavior of the event to be detected and the NULL class needs to be modeled to retain an early event detection.

Figure 21:
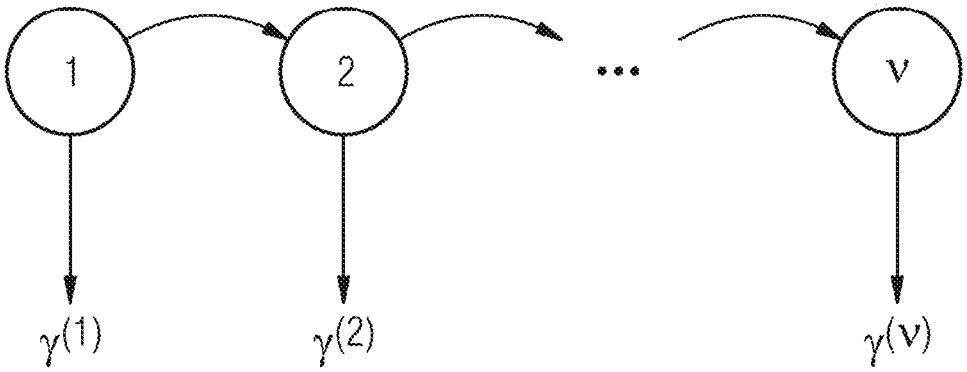
FIG. 21 is an illustration of a Hidden Markov Model of the event to be detected.

First, the event to be detected is characterized by phases:

$$z_K^{(n)} = \begin{cases} 1, \text{ if } z_K^{(n-1)} = 0 \wedge y^{(n)} = 1 \\ 2, \text{ if } z_K^{(n-1)} = 1 \wedge y^{(n)} = 1 \\ \vdots \\ v, \text{ if } z_K^{(n-1)} = v-1 \wedge y^{(n)} = 1 \end{cases},$$

where the random variable $z_K^{(n)}$ indicates the current phase of the event to be detected at a time instance n. This sequential process can be described as a Markov chain with the states $z_K$ as illustrated in FIG. 21. First-order Markov chains are defined as stochastic processes, where the next state $z_K^{(n+1)}$ only depends on the present state $z_K^{(n)}$. During classification, the phases of the event to be detected, i.e. the states $z_K$, are unknown or "hidden". Only outputs of the states $\gamma$ (e.g. feature vectors) can be observed. This leads to a HMM, which is described below.

Figure 22:
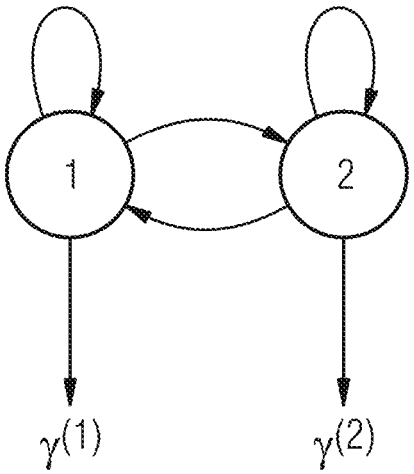
FIG. 22 is an illustration of a Hidden Markov Model of the NULL class.

In addition to the states of the event to be detected, the NULL class is also modelled by a finite number of states $z_N \in \{1,2\}$ as shown in FIG. 22. The transitions between these states are not specified a priori but during training of the HMM. The HMM can be extended to more states in order to improve the model of the NULL class.

Given the computed feature vectors, the problem is to find the underlying model, i.e. if the feature vectors were omitted by the HMM of the event to be detected or the NULL class. Therefore, the probability of observing the output $\gamma$ at a given state, $p(\gamma|z_K)$ and $p(\gamma|z_N)$ have to be determined. The observed feature vectors are not used as outputs of the HMMs directly.

The first stage classifier discriminates between the different phases of the event to be detected (states of its HMM) and the NULL class. The windows are classified independently. The posterior probability density functions $p(\tilde{z}|x)$ states $$\tilde{z} = \begin{cases} z_K, \text{ if } y = 1 \\ 0, \text{ if } y = 0 \end{cases},$$

given a feature vector x are computed. The individual probabilities of all states $\tilde{z}$ are inserted in the vector $\gamma=[p(\tilde{z}=0|x), \ldots, p(\tilde{z}=v|x)]^T$.

Figure 23:
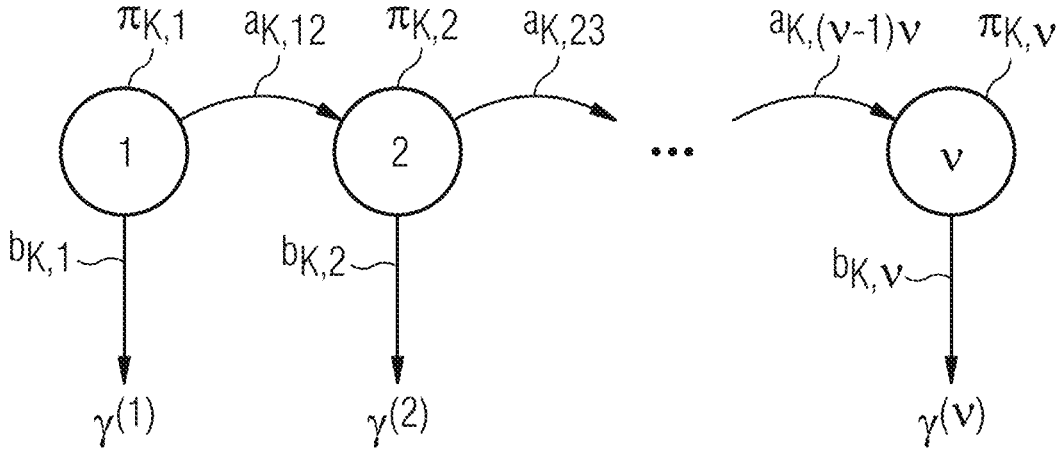
FIG. 23 is an illustration of a Hidden Markov Model of the event to be detected with states, outputs and parameters.
Figure 24:
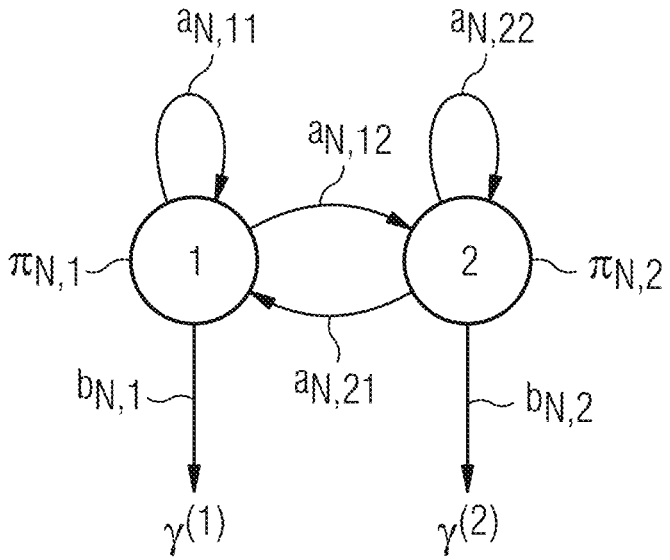
FIG. 24 is an illustration of a Hidden Markov Model of the NULL class with states, outputs and parameters.

The second stage classifier models the sequential behavior of the event to be detected and the NULL class by HMMs as depicted in FIGS. 21 and 22. Given the outputs $(\gamma^{(n-v+1)}, \ldots, \gamma^{(n)})$ computed by the first stage classifier at a time instance n, one decides whether the observations were omitted by the HMM of the event to be detected or the NULL class. Before that, the parameters describing the HMMs have to be determined as indicated in FIGS. 23 and 24, respectively.

HMMs are described by the transition probabilities between the states. Regarding the HMM of the event to be detected, the transition probability from state $z_K^{(n)}=i$ to state $z_K^{(n+1)}=j$, where i, $j \in \{1, \ldots, v\}$, is given by $a_{K,ij}=P(z_K^{(n+1)}=j|z_K^{(n)}=i)$. The transition matrix $A_K=\{a_{K,ij}\}$ contains these probabilities, where $a_{K,ij}$ corresponds to the element in the i-th row and j-th column. As it can be seen from FIG. 23, the transition matrix is sparse $$A_K = \begin{pmatrix} 0 & 1 & 0 & \ldots & 0 \\ 0 & 0 & 1 & \ldots & 0 \\ \vdots & \vdots & \vdots & \vdots & \vdots \\ 0 & 0 & 0 & \ldots & 1 \end{pmatrix},$$

as only one transition for every state $z_K$ is possible. In contrast, the transition matrix of the NULL class $A_N \in [0,1]^{2\times 2}$ is determined while training (described below).

Besides the transition probabilities, the emission probability density functions characterized an HMM. For the HMM of the event to be detected, the emission probability density function regarding state $z_K=i$ is given by $b_{K,i}=p(\gamma^{(i)}|z_K=i)$.

The emission probability density functions are summarized in array $B_K=\{b_{K,i}\}$, where $b_{K,i}$ corresponds to the element in the i-th row. The emission probability density functions can be assumed to be Gaussian distributed $p(\gamma|z_K=i) \sim N(\gamma; \mu_{K,i}, \Sigma_{K,i})$ with the $|\tilde{z}|$-dimensional mean vector $\mu_{K,i}$ and the $|\tilde{z}|\times|\tilde{z}|$ covariance matrix $\Sigma_{K,i}$, where $|\tilde{z}|$ denotes the number of possible states of the Markov chain. If the covariance matrix is a diagonal matrix, the components of $\gamma$ are statistically independent. Of course, instead of Gaussian distributed emission probability density functions, other multivariate distributions can be considered as well.

$B_N$ (see FIG. 24) involves the emission probability density functions of the NULL class. For each state, the emission probability density function is $p(\gamma^{(i)}|z_N=i) \sim N(\gamma^{(i)}; \mu_{N,i}, \Sigma_{N,i})$ with the $|\tilde{z}|$-dimensional mean vector $\mu_{N,i}$ and the $|\tilde{z}|\times|\tilde{z}|$ covariance matrix $\Sigma_{N,i}$, where $|\tilde{z}|$ denotes the number of possible states of the Markov chain.

In addition, the initial state probabilities $\pi_{K,i}=P(z_K=i)$ and $\pi_{N,i}=P(z_N=i)$ have to be determined to describe the HMMs completely with the parameter sets $\Theta_K=(A_K, B_K, \pi_K)$ and $\Theta_N=(A_N, B_N, \pi_N)$. The parameter sets $\Theta_K$ and $\Theta_N$ are learnt while training the HMMs as described in the following paragraph.

Given a labeled sequence $D^*=((z^{(1)}, \gamma^{(1)}), \ldots, (z^{(N)}, \gamma^{(N)}))$ as output of the first stage classifier, the HMM of the event to be detected is trained by supervised learning. Supervised means that the states $z_K$ of the event to be determined are known. This implies that the emission probability density functions $p(\gamma|z_K)$ can be computed directly by maximum likelihood estimation of $\mu_K$ and $\Sigma_K$ given the observations $\gamma^{(n)}$ with $\tilde{z}^{(n)} \in \{z_K\}$. Thus, $B_k$ is obtained. This leads to a fully defined HMM of the event to be detected, $\Theta_K$, as $A_K$ are known a priori and the initial state probabilities $\pi_K$ are assumed to be equal for all states.

Given a labeled sequence D* output of the first stage classifier, the HMM of the NULL class is trained by unsupervised learning. Unsupervised means that the states of the NULL class $z_N$ are unknown. This implies that the parameter set $\Theta_N$ needs to be estimated without knowing the corresponding states $z_N$. This is done by firstly finding sub-sequences of D* where $z^{(n)}=0$ holds. These sub-sequences serve as adjusted training data. Secondly, an expectation maximization algorithm finds the maximum likelihood estimate of the parameters $A_N$, $B_N$ and $\pi_N$. This algorithm is also known as Baum-Welch algorithm which is described in Collin F. Baker, Charles J. Fillmore and John B. Lowe, "The Berkeley fragment project", *Proceedings of the 36th Annual Meeting of the Association form Computational Linguistics and 17th International Conference on Computational Linguistics—Volume* 1, pages 86-90, Association form Computational Linguistics, 1998.

Finally, classification, i.e. estimating the event class in method step 124, is performed as follows: given an unlabeled sequence $(\gamma^{(n-v+1)}, \ldots, \gamma^{(n)})$ as output of the first stage classifier at a time instance n, the event class $\gamma^{(n)}$ is estimated by evaluating $L_K=P(D^*|\Theta_K)$ and $L_N=P(D^*|\Theta_N)$ i.e., the likelihoods of the HMMs of the event to be detected and the NULL class emitting the sequence D*. This is done by the Backward algorithm recursively evaluating the probabilities of all possible paths through the HMMs. The Backward algorithm is described in Richard O. Duda, Peter E. Hart and David G. Stork, "Pattern Classification", 2nd edition, John Wiley & Sons, 2000. Instead of the Backward algorithm, the Forward algorithm can be used as well as the time-reversed version of the Backward algorithm.

The Backward algorithm performs the following steps (in pseudocode):

$\beta_j^{(n)} \leftarrow 1 \forall\, j \in \{1,\ldots,|z|\},\ t \leftarrow n$
for $t \leftarrow t-1$ to $t = n-\eta+1$ do
  $\beta_i^{(t)} \leftarrow \Sigma_{j=1}^{|z|} \beta_j^{(t+1)} a_{ij} b_j(\gamma^{(t+1)}) \forall i \in \{1,\ldots|z|\}$
end for
return $L \leftarrow \Sigma_{i=1}^{|z|} \pi_i b_i(\gamma^{(n-\eta+1)}) \beta_i^{(n-\eta+1)}$ The index $\eta \leq v$ indicates the length of back-propagation. Therefore, the probabilities $b_{K,j}(\gamma)=p(\gamma|z_K=j)$ and $b_{N,j}(\gamma)=p(\gamma|z_N=j)$ are computed by evaluating the emission probability density functions at $\gamma^{(n-\eta+1)}, \ldots, \gamma^{(n)}$ for all states $z_K$ and $z_N$. The indices K and N indicating the event to be detected or the NULL class are dropped in the above pseudo-code of the Backward algorithm as the derived equations hold for both cases. In the case of the event to be detected, the algorithm simplifies to $$L_K = \sum_{i=1}^{|z_K|} \pi_{K,i} \prod_{j=max(1,i-\eta+1)}^{i} b_{K,j}\left(\gamma^{(n+j-i)}\right)$$

as $A_K$ is sparse and only one transition is possible for every state $z_K \in \{1, \ldots v\}$. After computing the likelihoods $L_K$ and $L_N$, $\hat{y}^{(n)}$ is found by evaluating $$\hat{y}^{(n)} = \begin{cases} 1, \text{ if } \log(L_K) - \log(L_N) > \delta \\ 0, \text{ otherwise} \end{cases}.$$

The threshold $\delta$ is a design parameter. If $\delta$ is exceeded, one decides for the event to be detected ($\hat{y}^{(n)}=1$). Otherwise, the observations are likely to belong to the NULL class ($\hat{y}^{(n)}=0$).

In the following, further examples are described to facilitate the understanding of the invention:

1. Shoe (100) for ball sports, comprising:
   a. an upper (101) having an outer surface (102);
   b. an actuator (104) being configured to change at least one surface property of a portion of the outer surface (102) of the upper (101);
   c. a sensor (105) being sensitive to movements of the shoe (100); and
   d. a processing unit (106) connected to the actuator (104) and the sensor (105) and being configured to process sensor data retrieved from the sensor (105) and to cause the actuator (104) to change the at least one surface property of the portion of the outer surface (102) of the upper (101) if a predetermined event is detected in the sensor data.
2. Shoe according to the preceding example, wherein the at least one surface property is the surface structure of the portion of the outer surface.
3. Shoe according to one of the preceding examples, wherein the at least one surface property is the friction of the portion of the outer surface.
4. Shoe according to one of the preceding examples, wherein the at least one surface property is the surface area of the portion of the outer surface.
5. Shoe according to one of the preceding examples, wherein at least the portion of the outer surface of the upper is elastic and the shoe further comprises: a plurality of fins arranged below the portion of the outer surface of the upper and connected to the actuator, such that the fins can be lowered or raised by means of the actuator to change the at least one surface property of the elastic outer surface.
6. Shoe according to example 1, wherein at least the portion of the outer surface of the upper is elastic and the actuator is a pneumatic valve and the shoe further comprises:
   an air pump configured to provide pressurized air to the pneumatic valve; and
   at least one inflatable element arranged under the elastic outer surface of the upper;
   wherein the pneumatic valve is configured to provide pressurized air to the inflatable element to inflate the inflatable element and to change the at least one surface property of the portion of the outer surface.
7. Shoe according to the preceding example, wherein the pressurized air is generated through actions of a player wearing the shoe.
8. Shoe according to example 1, wherein at least the portion of the outer surface of the upper is elastic and the shoe further comprises:
   a plurality of pins arranged below the elastic outer surface of the upper; and
   an undulating structure arranged below the plurality of pins and connected to the actuator, such that the undulating structure can be moved relative to the pins to lower or raise the pins with respect to the outer surface to change the at least one surface property of the portion of the outer surface.
9. Shoe according to example 1, wherein the portion of the outer surface comprises a plurality of flaps, which are configured to be lowered or raised by means of the actuator.
10. Shoe according to one of the preceding examples, wherein the actuator is based on a shape memory alloy or an electrical motor.

11. Shoe according to one of the preceding examples, wherein the sensor is an accelerometer, a gyroscope or a magnetic field sensor.
12. Shoe according to one of the preceding examples, wherein the outer surface is skin-like.
13. Shoe according to one of the preceding examples, further comprising:
    a sole, wherein the sensor, actuator and processing unit are integrated in the sole.
14. Shoe according to the preceding example, wherein the predetermined event is a kick.
15. Shoe according to one of the preceding examples, wherein the predetermined event is a short pass, long pass, shot, or control of a ball.
16. Shoe according to one of the preceding examples, wherein the processing unit is adapted to detect the predetermined event by performing the following steps:
    a. retrieving a time-series of sensor data from the sensor;
    b. preprocessing (910) the time-series;
    c. segmenting (920) the time-series in a plurality of windows;
    d. extracting (930) a plurality of features from the sensor data in each of the plurality of windows; and
    e. estimating (940) an event class associated with the plurality of windows based on the plurality of features extracted from the sensor data in the plurality of windows.
17. Shoe according to example 16, wherein the time-series is preprocessed by digital filtering using for example a non-recursive moving average filter, a Cascade Integrator Comb (CIC) filter or a filter bank.
18. Shoe according to one of examples 16 to 17, wherein the event class comprises at least the event to be detected and a NULL class associated with sensor data that does not belong to a specific event.
19. Shoe according to one of examples 16 to 18, wherein the features are based at least on one of temporal, spatio-temporal, spectral, or ensemble statistics by applying, for example, wavelet analysis, principal component analysis, PCA, or Fast Fourier Transform, FFT.
20. Shoe according to one of examples 16 to 19, wherein the features are based on one of simple mean, normalized signal energy, movement intensity, signal magnitude area, correlation between axes, maximum value in a window, minimum value in a window, maximum detail coefficient of a wavelet transform, correlation with a template, projection onto a principal component of a template, distance to an eigenspace of a template, spectral centroid, bandwidth, or dominant frequency.
21. Shoe according to one examples 16 to 20, wherein the time-series is segmented in a plurality of windows based on a sliding window.
22. Shoe according to one of examples 16 to 21, wherein the time-series is segmented in a plurality of windows based on at least one condition present in the time-series.
23. Shoe according to the preceding example, wherein the condition is the crossing of the sensor data of a defined threshold or the matching of a template using correlation, Matched Filtering, Dynamic Time Warping, or Longest Common Subsequence (LCSS) and its sliding window variant, warping LCSS.
24. Shoe according to one examples 16 to 23, wherein the event class is estimated based on a Bayesian classifier such as Naïve Bayes classifier, a maximum margin classifier such as Support Vector Machine, an ensemble learning algorithm such as AdaBoost classifier and Random Forest classifier, a Nearest Neighbor classifier, a Neural Network classifier, a Rule based classifier, or a Tree based classifier.
25. Shoe according to one of examples 16 to 24, wherein the event class is estimated based on probabilistic modeling the sequential behavior of the events and a NULL class by Conditional Random Fields, dynamic Bayesian networks or other.
26. Shoe according to one of examples 16 to 25, wherein the event class is estimated based on a hybrid classifier, comprising the steps of:
    a. discriminating between different phases of the event to be detected and a NULL class, wherein the NULL class is associated with sensor data that does not belong to a specific event; and
    b. modeling the sequential behavior of the event and the NULL class by dynamic Bayesian networks.
27. Shoe according to one of examples 16 to 26, wherein the step of estimating is based on a classifier which has been trained based on supervised learning.
28. Shoe according to one of examples 16 to 27, wherein the step of estimating is based on a classifier which has been trained based on online learning.
29. Shoe according to one of examples 16 to 28, wherein the step of estimating is based on dynamic Bayesian networks which have been trained based on unsupervised learning.
30. Shoe according to one of the preceding examples, wherein the predetermined event is detected in real-time.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A shoe for ball sports, the shoe comprising:
an upper comprising an outer surface;
a sensor for sensing movements of the shoe,
a shape memory alloy arranged to direct an outward force toward a portion of the outer surface of the upper; and
a processing unit for controlling the shape memory alloy to change at least one surface property of the portion of the outer surface based on sensor data from the sensor.

2. The shoe according to claim 1, wherein the at least one surface property is a surface structure, a friction, or a surface area of the portion of the outer surface.

3. The shoe according to claim 1, wherein the shoe further comprises a plurality of fins arranged below the portion of the outer surface of the upper and connected to the shape memory alloy, such that the fins can be lowered or raised by the shape memory alloy to change the at least one surface property of the outer surface.

4. The shoe according to claim 1, wherein the shoe further comprises:
a plurality of pins arranged below the portion of the outer surface of the upper; and an undulating structure arranged below the plurality of pins and connected to the shape memory alloy to be movable by the shape memory alloy, such that the undulating structure can be moved relative to the pins to lower or raise the pins with respect to the outer surface to change the at least one surface property of the portion of the outer surface.

5. The shoe according to claim 1, wherein the portion of the outer surface comprises a plurality of flaps, which are configured to be lowered or raised by movement imparted by the shape memory alloy.

6. The shoe according to claim 1, wherein the shape memory alloy is arranged at least partially under the portion of the outer surface of the upper.

7. The shoe according to claim 1, further comprising a sole, wherein the sensor, the shape memory alloy, and the processing unit are integrated in the sole.

8. The shoe according to claim 1, wherein at least a portion of the shape memory alloy extends into the upper from a sole of the shoe.

9. The shoe according to claim 1, wherein the processing unit is configured to process sensor data retrieved from the sensor and to cause the shape memory alloy to change the at least one surface property of the outer surface of the upper based on a detection of a predetermined event in the sensor data.

10. The shoe according to claim 9, wherein the predetermined event is a kick, a short pass, long pass, shot, or control of a ball.

11. The shoe according to claim 1, wherein the shape memory alloy comprises a wire that contracts from an original length or shape upon reaching a threshold temperature from current flowing through the wire and that relaxes to return to the original length or shape upon cooling down below the temperature threshold.

12. An article of footwear comprising:

an upper comprising an outer surface;

a sensor for sensing movement of the article of footwear, a shape memory alloy arranged to direct an outward force toward a portion of the outer surface of the upper; and a processing unit for controlling the shape memory alloy to change at least one surface property of the portion of the outer surface based on sensor data from the sensor.

13. The article of footwear according to claim 12, further comprising a sole.

14. The article of footwear according to claim 12, wherein the shape memory alloy is arranged at least partially under the portion of the outer surface of the upper.

15. The article of footwear according to claim 12, further comprising an inner layer, and wherein the shape memory alloy is arranged to change the at least one surface property of the portion of the outer surface relative to the inner layer.

16. An article of footwear comprising:

an upper comprising an outer surface; and a shape memory alloy arranged to direct an outward force toward a portion of the outer surface of the upper, the shape memory alloy configured to be coupled with a processing unit for controlling the shape memory alloy to change at least one surface property of the portion of the outer surface based on sensor data from a sensor for sensing movements.

17. The article of footwear according to claim 16, further comprising the processing unit.

18. The article of footwear according to claim 16, further comprising the sensor.

19. The article of footwear according to claim 18, wherein the sensor is configured for sensing movements of the article of footwear.

20. The article of footwear according to claim 16, further comprising a sole into which the sensor and the processing unit are integrated.

* * * * *